US007432645B2

(12) United States Patent
Yoo

(10) Patent No.: US 7,432,645 B2
(45) Date of Patent: Oct. 7, 2008

(54) ELECTRON EMISSION DEVICE AND ELECTRON EMISSION DISPLAY USING THE SAME

(75) Inventor: Seung Joon Yoo, Suwon (KR)

(73) Assignee: Samsung SDI Co., Ltd., Suwon-si (KR)

( * ) Notice: Subject to any disclaimer, the term of this patent is extended or adjusted under 35 U.S.C. 154(b) by 307 days.

(21) Appl. No.: 11/090,701

(22) Filed: Mar. 24, 2005

(65) Prior Publication Data

US 2005/0248257 A1 Nov. 10, 2005

(30) Foreign Application Priority Data

Mar. 31, 2004 (KR) ..... 10-2004-0021935

(51) Int. Cl.
*H01J 1/62* (2006.01)
*H01J 63/04* (2006.01)

(52) U.S. Cl. ..... 313/497; 313/306; 313/310

(58) Field of Classification Search ..... 313/495–497, 313/306, 310
See application file for complete search history.

(56) References Cited

U.S. PATENT DOCUMENTS

| | | | |
|---|---|---|---|
| 5,264,758 | A | 11/1993 | Iijima et al. |
| 5,653,619 | A | 8/1997 | Cloud et al. |
| 5,936,343 | A | 8/1999 | Fushimi et al. |
| 5,965,972 | A | 10/1999 | Takada et al. |
| 5,981,404 | A | 11/1999 | Sheng et al. |
| 6,062,931 | A | 5/2000 | Chuang et al. |
| 6,066,507 | A | 5/2000 | Rolfson et al. |
| 6,097,138 | A | 8/2000 | Nakamoto |
| 6,144,153 | A | 11/2000 | Nakatani |
| 6,400,091 | B1 | 6/2002 | Deguchi et al. |
| 6,583,549 | B2 | 6/2003 | Takenaka et al. |

(Continued)

FOREIGN PATENT DOCUMENTS

KR 2001-0046803 6/2001

(Continued)

OTHER PUBLICATIONS

Korean Patent Abstract, Publication No. 1020010046803 A, Published on Jun. 15, 2001, in the name of Han, et al.

(Continued)

*Primary Examiner*—Karabi Guharay
*Assistant Examiner*—Bumsuk Won
(74) *Attorney, Agent, or Firm*—Christie, Parker & Hale, LLP

(57) ABSTRACT

Disclosed is an electron emission device and an electron emission display using the same, wherein the electron emission device has an improved structure for focusing an electron beam. The electron emission device comprises: first and second electrodes formed on a plate and spaced from each other by a predetermined distance; an insulator formed on the entire area of the plate and formed with an opening through which a portion of the first electrode between the first and second electrodes is at least partially exposed; an electron emitter formed on a predetermined region of the first electrode and exposed through the opening; and a third electrode formed on the insulator and connected to the second electrode, wherein a voltage difference between the first and second electrodes causes the electron emitter to emit an electron and the emitted electron is focused by the third electrode.

8 Claims, 23 Drawing Sheets

U.S. PATENT DOCUMENTS

| | | | | |
|---|---|---|---|---|
| 6,621,232 | B2 | 9/2003 | Jo et al. | |
| 6,756,729 | B1 | 6/2004 | Na et al. | |
| 6,791,278 | B2 | 9/2004 | Russ et al. | |
| 7,042,144 | B2 | 5/2006 | Takahashi et al. | |
| 7,090,555 | B2 | 8/2006 | Lee et al. | |
| 2002/0017875 | A1 | 2/2002 | Lee et al. | |
| 2002/0036460 | A1 | 3/2002 | Takenaka et al. | |
| 2002/0079802 | A1 | 6/2002 | Inoue et al. | |
| 2004/0124762 | A1 | 7/2004 | Fushimi | |
| 2005/0077812 | A1 | 4/2005 | Takenaka et al. | |
| 2005/0116600 | A1* | 6/2005 | Chi et al. | 313/293 |

FOREIGN PATENT DOCUMENTS

| | | |
|---|---|---|
| KR | 2002-0078977 | 10/2002 |

OTHER PUBLICATIONS

Korean Patent Abstract, Publication No. 1020020078977 A, Published on Oct. 19, 2002, in the name of Cha, et al.

Shackelford, J., et al., CRC Materials Science and Engineering Handbook, 3rd Edition, 2001, Tables 291 & 292.

Edinger, K., et al., *Study of precursor gases for focused ion beam insulator deposition*, J. Vac. Sci. Technol. B, vol. 16, No. 6, Nov./Dec. 1998, pp. 3311-3314.

Office action dated May 31, 2007 for related U.S. Appl. No. 11/348,570, citing the above noted references (except 6,062,931).

* cited by examiner

ELECTRON EMISSION DEVICE AND ELECTRON EMISSION DISPLAY USING THE SAME

CROSS-REFERENCE TO RELATED APPLICATIONS

This application claims priority to and the benefit of Korean Patent Application No. 2004-21935, filed Mar. 31, 2004, with the Korean Intellectual Property Office, the entire disclosure of which is incorporated by reference.

FIELD OF THE INVENTION

The present invention relates to an electron emission device and an electron emission display using the same to provide improved electron focusing efficiency.

BACKGROUND OF THE INVENTION

An electron emission device comprises an electron emission source for emitting electrons, and a display portion for displaying a picture when the emitted electrons collide with a fluorescent layer. One example of an electron emission display is a field emission display (FED). In a FED, electrons are emitted from an electron emitter provided on a cathode electrode, and the emitted electrons collide with a fluorescent layer provided on an anode electrode, so that the fluorescent layer emits light, thereby producing an image. In the FED, a triode structure comprising a cathode electrode, a gate electrode, and an anode electrode is widely used.

A good electron emission display requires sufficient brightness and a fine pitch. To achieve sufficient brightness, a sufficient emission current is required, and to achieve a fine pitch, an electron beam with a small diameter should be focused on the fluorescent layer. Therefore, various methods have been proposed to reduce the diameter of the electron beam emitted from the electron emission device.

By way of example, a structure comprising a focusing electrode which applies electric power between a cathode plate and an anode plate is disclosed in U.S. Pat. No. 5,508,584. FIG. 1 is a schematic sectional view illustrating a portion of a conventional electron emission display.

Referring to FIG. 1, a cathode plate 50 comprises a buffer layer 54 formed on a lower plate 52, a cathode electrode 56 formed on the buffer layer 54, and a micro-tip 60 formed within a gate hole 64 patterned on the cathode electrode 56. The gate hole 64 is employed for patterning a gate insulator 58 and a gate electrode 62 laminated in sequence.

Furthermore, an anode plate 48 comprises a transparent electrode 34 formed on a top plate 32, and a fluorescent layer 44 formed on the transparent electrode 34. Here, the fluorescent layer 44 corresponds to the micro-tip 60. A power supply (not shown) supplies electric power to the fluorescent layer 44.

Additionally, a focusing electrode 38 is provided for focusing the emitted electron beam and allowing the electrons to accurately collide with the fluorescent layer 44. The focusing electrode 38 is formed by patterning an insulator 36 and the electrode layer 34 in sequence, requiring an increased number of fabricating steps, thereby lowering productivity.

Furthermore, even though a focusing electrode 38 may be added to the electron emission display, the focusing of the electron beam is still generally unsatisfactory.

SUMMARY OF THE INVENTION

Accordingly, in one embodiment of the present invention, an electron emission device and an electron emission display using the same are provided, wherein the electron emission device has an improved structure for focusing an electron beam.

According to an embodiment of the invention, an electron emission device and an electron emission display using the same are provided, wherein the electron emission device is fabricated by a simple process at low cost, and provides improved focusing efficiency.

According to an embodiment of the present invention, an electron emission device is provided comprising: first and second electrodes formed on a plate and spaced from each other by a predetermined distance; an insulator formed on the plate and having an opening through which at least a portion of the first electrode is exposed; an electron emitter formed on a predetermined region of the first electrode and exposed through the opening; and a third electrode formed on the insulator and connected to the second electrode, wherein when a voltage difference between the first and second electrodes causes the electron emitter to emit electrons and the emitted electrons are focused by the third electrode.

According to an embodiment of the invention, the third electrode surrounds the opening, and the electron emitter comprises a material such as a carbon nano-tube (CNT), graphite, diamond-like carbon (DLC), or combinations thereof, or comprises a nano-tube or a nano-wire of silicon (Si) or silicon carbide (SiC).

According to an embodiment of the invention, the portion of the first electrode exposed through the opening is covered with an insulator except the portion occupied by the electron emitter thereof.

According to another embodiment of the invention, the electron emission device further comprises an optional resistance layer between the second electrode and the third electrode.

According to another embodiment of the present invention, an electron emission device is provided comprising: first and second electrodes formed on a plate and spaced from each other by a predetermined distance; an insulator formed on the plate and having an opening through which at least a portion of the second electrode is exposed; an electron emitter formed on a predetermined region of the second electrode and exposed through the opening; and a third electrode formed on the insulator and connected to the second electrode, wherein a voltage difference between the first and second electrodes causes the electron emitter to emit electrons, and the emitted electrons are focused by the third electrode.

According to another embodiment of the invention, the portion of the second electrode exposed through the opening is covered with the insulator except the portion occupied by the electron emitter thereof.

According to still another embodiment of the invention, the electron emission device further comprises a resistance layer between the second electrode and the third electrode.

An electron emission display according to an embodiment of the invention comprises: a first plate; a second plate opposite to and spaced from the first plate at a predetermined distance; and a supporter supporting the first and second plates to maintain a space between the two, wherein on the first plate a gate line and a cathode line are formed perpendicular to one another in a cross shape to define each pixel, each pixel comprising at least one electron emission device, the electron device comprising: first and second electrodes formed on the first plate and spaced from each other by a predetermined distance; an insulator formed on the first plate and having an opening through which at least a portion of the first electrode is exposed; an electron emitter formed on a predetermined region of the first electrode and exposed through the opening; and a third electrode formed on the insulator and connected to the second electrode, wherein a voltage difference between the first and second electrodes causes the electron emitter to emit electrons which are focused by the third electrode.

According to one embodiment of the invention, the gate line comprises the same material as the third electrode, and the cathode line is formed separately from the first electrode and connected to the first electrode.

In yet another embodiment of the present invention, an electron emission display comprises a first plate; a second plate opposite to and spaced from the first plate by a predetermined distance; and a supporter supporting the first and second plate to maintain a space between the two, wherein on the first plate are formed a gate line and a cathode line perpendicular to one another in a cross shape to define a pixel, the pixel comprising at least one electron emission device, the electron device comprising: first and second electrodes formed on the first plate and spaced from each other at a predetermined distance; an insulator formed on the first plate and having an opening through which at least portion of the second electrode is exposed; an electron emitter formed on a predetermined region of the second electrode and exposed through the opening; and a third electrode formed on the insulator and connected to the second electrode, wherein a voltage difference between the first and second electrodes causes the electron emitter to emit electrons and the emitted electrons are focused by the third electrode.

According to another embodiment of the invention, the gate line comprises the same material as the third electrode, and the cathode line is formed separately from the first electrode and connected to the first electrode.

In still another embodiment of the present invention, an electron emission device comprises first and second electrodes formed on a plate and spaced from each other by a predetermined distance; an insulator on the plate having an opening through which at least a portion of the first electrode is exposed; an electron emitter formed on a predetermined region of the first electrode and exposed through the opening; and third and fourth electrodes formed on the insulator, spaced from each other by a predetermined distance, and connected to the first and second electrodes respectively, wherein a voltage difference between the first and second electrodes causes the electron emitter to emit electrons and the emitted electrons are focused by the third and fourth electrodes.

According to another embodiment of the invention, the third electrode and the fourth electrode surround the opening, and the electron emitter includes a material selected from the group consisting of nano tubes such as carbon nano tubes (CNT), nano wire, silicon (Si), silicon carbide (SiC), diamond-like carbon (DLC), graphite, or combinations thereof.

According to another embodiment of the invention, the electron emission device further comprises a resistance layer between the first electrode and the third electrode.

According to yet another embodiment of the invention, the electron emission device further comprises a resistance layer between the second electrode and the fourth electrode.

According to another embodiment of the present invention, an electron emission display comprises a first plate; a second plate opposite to and spaced from the first plate at a predetermined distance; and a supporter supporting the first and second plate with a space between, wherein on the first plate are formed a gate line and a cathode line perpendicular to one another in a cross shape to define a pixel, the pixel comprising at least one electron emission device, the electron device comprising first and second electrodes formed on the first plate and spaced from each other by a predetermined distance; an insulator on the first plate and having an opening through which at least portion of the first electrode is exposed; an electron emitter formed on a predetermined region of the first electrode and exposed through the opening; and third and fourth electrodes formed on the insulator, spaced from each other by a predetermined distance, and connected to the first and second electrodes respectively, wherein a voltage difference between the first and second electrodes causes the electron emitter to emit an electron and the emitted electron is focused by the third and fourth electrodes.

According to still another embodiment of the invention, the gate line comprises the same material as the third electrode and is formed on the same plane as the third electrode, and the cathode line is formed separately from the first electrode and is connected to the first electrode.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION

Here, certain embodiments of the present invention will be described in detail with reference to the accompanying drawings, wherein preferred embodiments of the present invention are readily understood by those skilled in the art such that other modifications would be apparent and the present invention is not limited to the embodiments disclosed herein.

First Embodiment

Electron Emission Device

Here, an electron emission device according to a first embodiment of the present invention will be described in detail with reference to FIG. 2A which is a schematic sectional view of an electron emission device.

Figure 1:
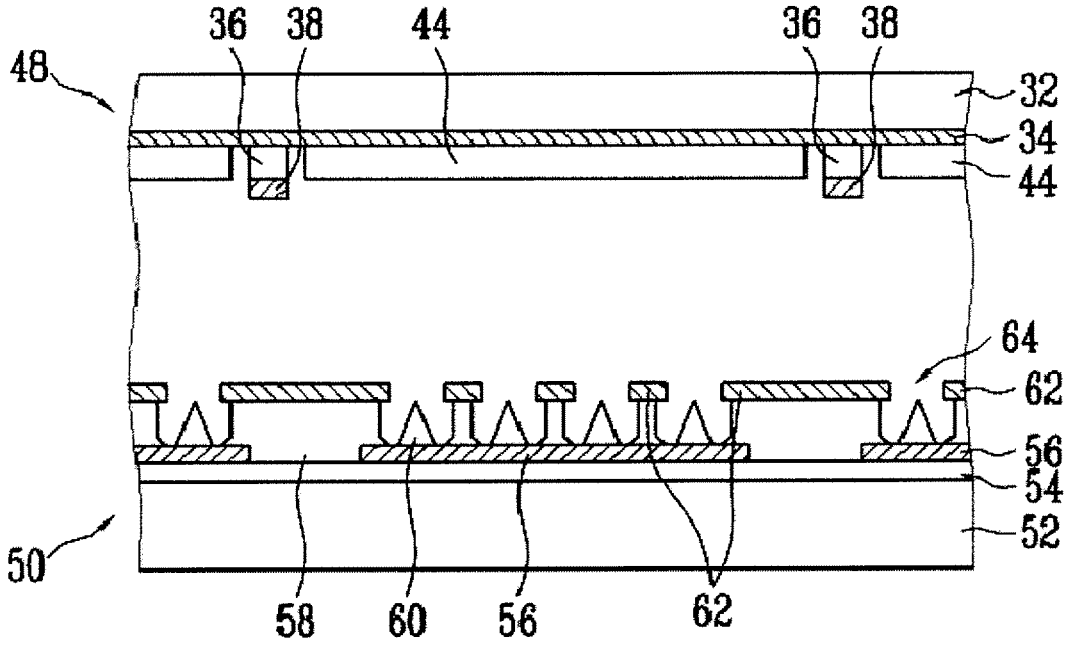
FIG. 1 (PRIOR ART)
FIG. 1 is a schematic sectional view illustrating a portion of a conventional electron emission display.
Figure 2A:
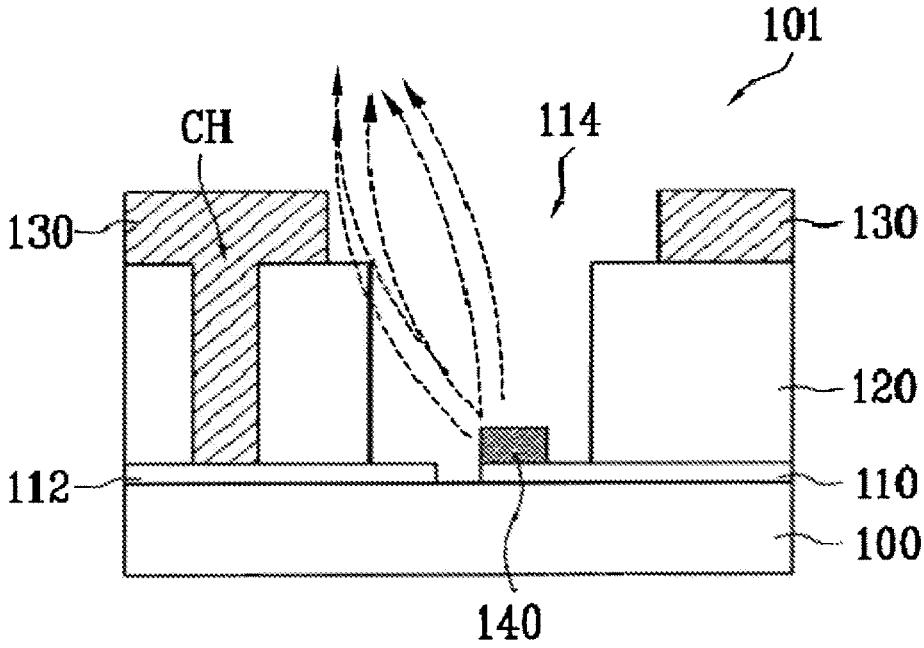
FIG. 2A through 2D are schematic sectional views of electron emission devices according to different embodiments of the present invention.

Referring to FIG. 2A, an electron emission device 201 comprises first and second electrodes 210 and 212 formed on a plate 200 and spaced from each other by a predetermined distance. An insulator 220 is formed on the first and second electrodes 210 and 212 and includes an opening 214 through which the first and second electrodes 210 and 212 are partially exposed with an electron emitter 240 formed on a predetermined region of the first electrode 210 within the opening 214. The first electrode 210 and the second electrode 212 may be made of the same materials or different materials, and are both deposited on the plate 200. In FIG. 2A, both the first and second electrodes 210 and 212 are exposed through the opening 214, but in an alternative embodiment, only the first electrode 210 that is formed with the electron emitter 240 is exposed through the opening 214.

A third electrode 230 is electrically connected to the second electrode 212 through a contact hole (CH) formed through the insulator 220. When the voltage difference between the first and second electrodes 210 and 212 causes the electron emitter 240 to emit electrons, an equivalent voltage is also applied to the third electrode 230, thereby focusing the emitted electrons. In other embodiments, the third electrode 230 may vary in arrangement, shape, or the like. Preferably, the third electrode 230 is designed to surround the opening 214, thereby enhancing focusing efficiency of the electron beam.

In this specification, "surround" is intended to mean that the third electrode 230 extends either entirely or at least partially around the outer circumference of the opening 214. For example, the opening may be shaped like a rectangle with at least two of the four sides of the rectangle surrounded by the electrode.

The plate 200 can be made of various materials. Examples include glass, vitreous materials low in impurities such as sodium (Na), or the like, silicon substrates coated with an insulator such as silicon oxide ($SiO_2$), ceramic substrates, or the like.

The first electrode 210 and the second electrode 212 can be formed of the same material, for example, a metal such as chromium (Cr), aluminum (Al), molybdenum (Mo), copper (Cu), nickel (Ni), or gold (Au), to a thickness of 1,000 Å through 10,000 Å using general deposition techniques. As necessary, the first and second electrodes 210 and 212 may be formed of a transparent conductive material such as indium tin oxide (ITO), zinc oxide (ZnO), or similar materials with a thickness of 1,000 Å to 2,000 Å. In one embodiment a transparent conductive layer is preferred and is useful in producing a rear-exposure device using a lithography process.

The insulator 220 can be deposited by various depositing techniques such as screen printing, sputtering, chemical vapor deposition (CVD), or vacuum deposition, wherein the thickness of the insulator 220 can range from a few nm to a few dozens of μm. The insulator 220 may comprise silicon oxide ($SiO_2$), or silicon nitride ($SiN_x$). Like the first and second electrodes 210 and 212, the third electrode 230 can be also made of a metal such as chromium (Cr), aluminum (Al), molybdenum (Mo), copper (Cu), nickel (Ni), gold (Au), etc., to a thickness of a few μm by general deposition techniques.

The electron emitter 140 can include a material selected from the group consisting of nano tubes such as carbon nano tubes (CNT), nano wire, fullerene ($C_{60}$), diamond-like carbon (DLC), graphite, or combinations thereof. According to one embodiment, carbon nano tubes are preferred.

Where the first electrode 210 is partially exposed through the opening 214 and formed with the electron emitter 240 thereon, and the second electrode 212 is wholly covered by the insulator, current leakage can be prevented. Alternatively, the entire area of the first electrode 210 except the electron emitter 240 thereof may be covered with the insulator 220.

Figure 2B:
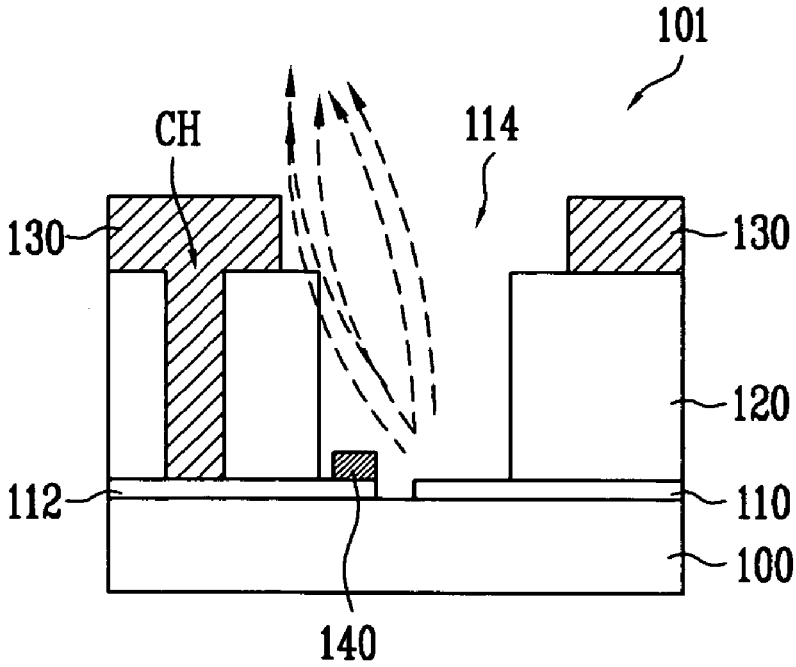

FIG. 2B is a schematic sectional view of a variation of the electron emission device in FIG. 2A. Referring to FIG. 2B, an electron emission device 101 comprises first and second electrodes 110 and 112 formed on a plate 100 and spaced from each other by a predetermined distance; an insulator 120 formed on the first and second electrodes 110 and 112 with an opening 114; an electron emitter 140; and a third electrode 130 electrically connected to the second electrode 112 by a contact hole (CH) passing through the insulator 120. The first and second electrodes 110 and 112 are partially exposed through the opening 114, and the electron emitter 140 is formed on a predetermined region of the second electrode 112 within the opening 114. Compared with the electron emission device of FIG. 2A, the electron emission device of FIG. 2B places the electron emitter 140 on the second electrode 112 rather than on the first electrode 110.

Figure 2C:
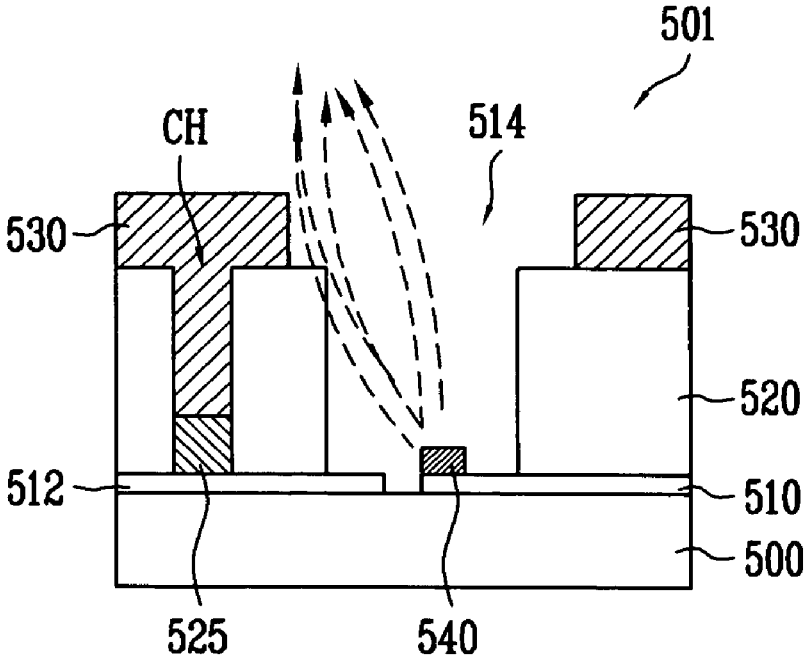

FIG. 2C is a schematic sectional view of another variation of the electron emission device of FIG. 2A. Referring to FIG. 2C, an electron emission device 501 comprises first and second electrodes 510 and 512 formed on a plate 500 and spaced from each other by a predetermined distance; an insulator 520 formed on the first and second electrodes 510 and 512 with an opening 514; an electron emitter 540; and a third electrode 530 electrically connected to the second electrode 512 through a contact hole (CH) passing through the insulator 520.

According to this embodiment, a resistive layer 525 is additionally provided between the second electrode 512 and the third electrode 530. The resistive layer 525 drops the voltage and is useful where the voltage applied to the third electrode 530 should be lower than that applied to the second electrode 512. The resistive layer 525 can vary in material, thickness, arrangement or the like, as long as it lowers the voltage between the second electrode 512 and the third electrode 530 by the desired amount. Preferably, the resistive layer 525 includes $RuO_2$ ($\sim 10^{-5}$Wcm), $Cr0_2$($\sim 10^{-3}$Wcm), $C_2O_3$($\sim 10^{3}$Wcm), $Lu_2O_3$($\sim 10^{-1}$Wcm), or similar compounds.

Figure 2D:
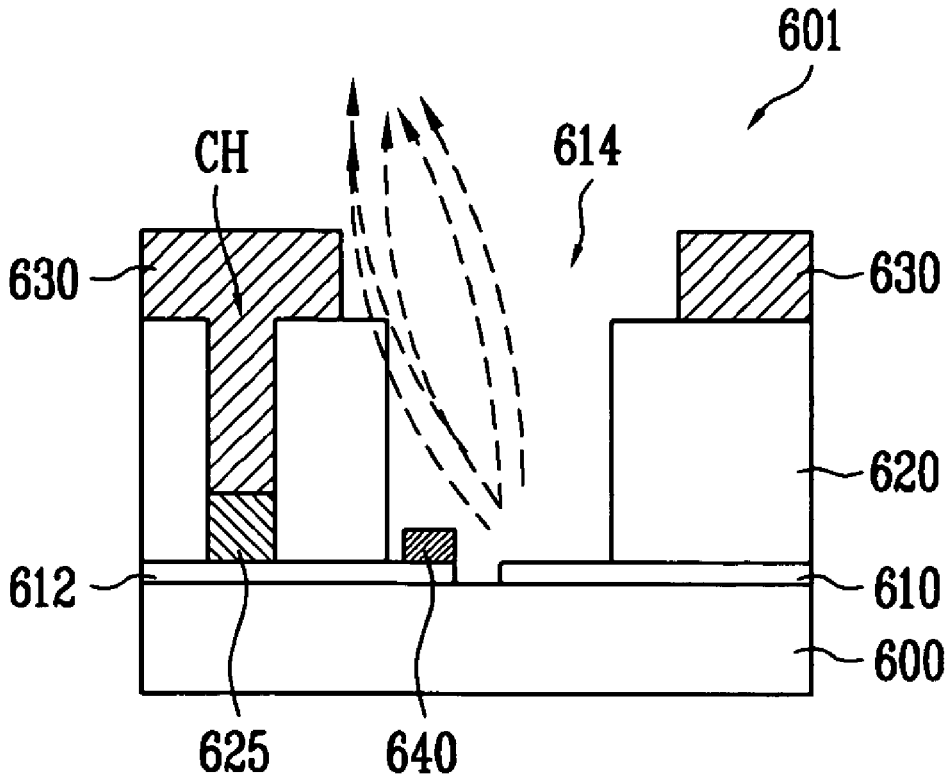

FIG. 2D is a schematic sectional view of another variation of the electron emission device of FIG. 2A. Referring to FIG. 2D, an electron emission device 601 comprises first and second electrodes 610 and 612 formed on a plate 600 and spaced from each other by a predetermined distance; an insulator 620 formed on the first and second electrodes 610 and 612 with an opening 614; an electron emitter 640; and a third electrode 630 formed on the insulator 620. The first and second electrodes 610 and 612 are partially exposed through the opening 614, and the electron emitter 640 is formed on a predetermined region of the second electrode 612 within the opening 614. According to this embodiment, the third electrode 630 is electrically connected to the second electrode 612 through a contact hole (CH) passing through the insulator 620 with a resistive layer 625 additionally provided between the second electrode 612 and the third electrode 630.

Electron Emission Display

Figure 3:
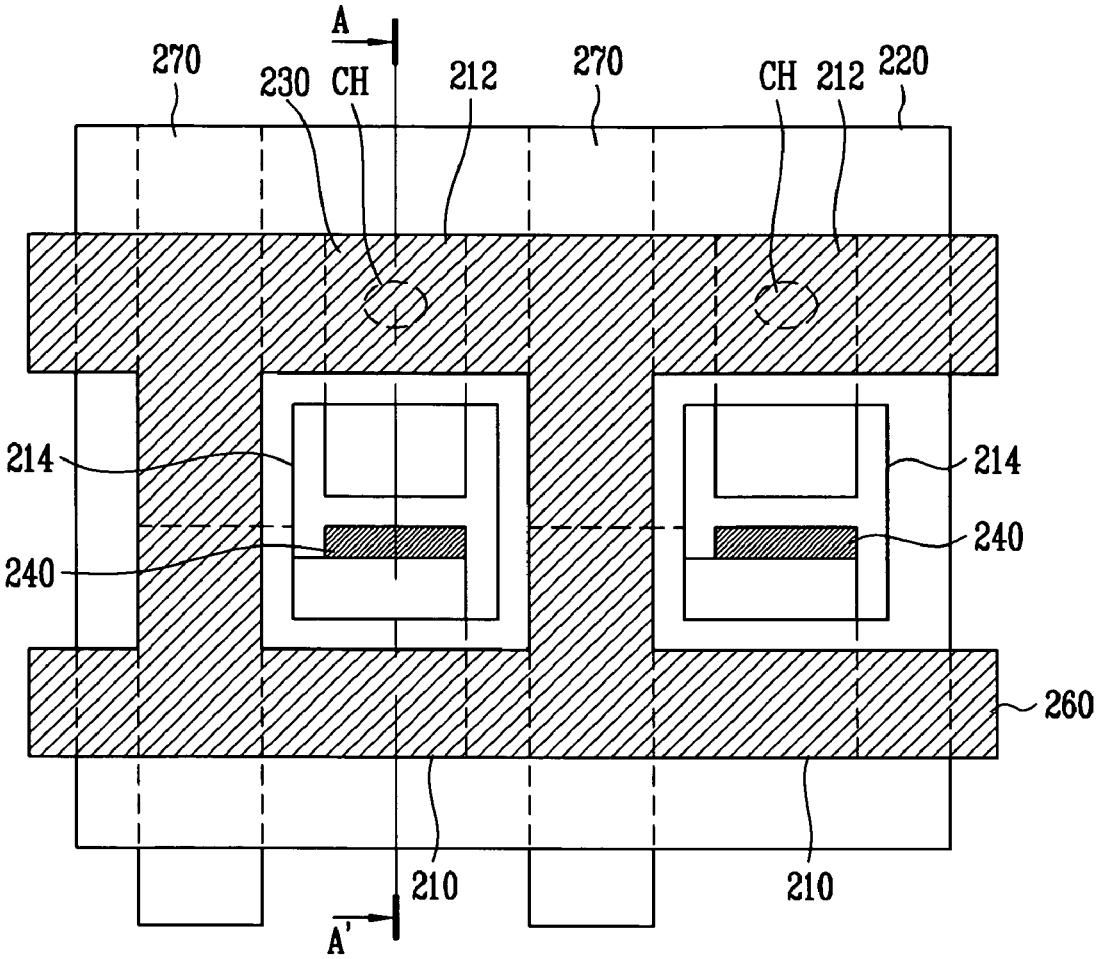
FIG. 3 is a plan view of an electron emission display using the electron emission device of FIG. 2A.
Figure 4:
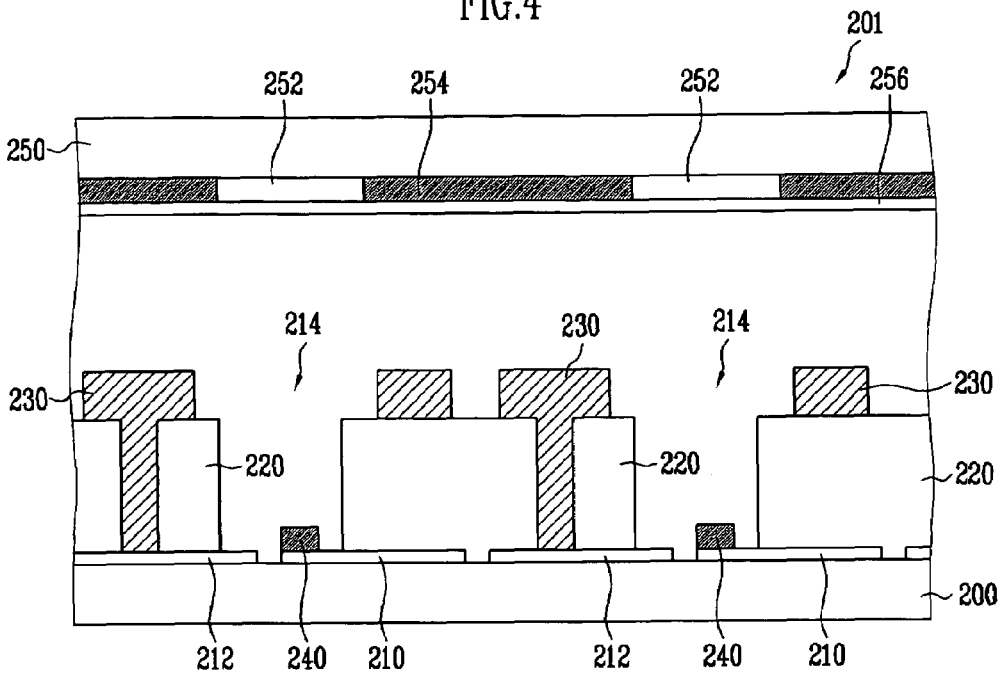
FIG. 4 is a sectional view taken along line A-A' of the electron emission display of FIG. 3.

FIGS. 3 and 4 are views illustrating an electron emission display using the electron emission device of FIG. 2A, wherein FIG. 3 is a plan view of the electron emission display; and FIG. 4 is a sectional view of the electron emission display, taken along line A-A' of FIG. 3.

As shown, an electron emission display 201 comprises a first plate 200 and a second plate 250 spaced from each other by a predetermined distance and facing each other. The first and second plates 200, 250 are sealed together form a vacuum container. On the first plate 200 are formed gate lines 260 and cathode lines 270, thereby defining pixels. The gate lines 260 and the cathode lines 270 are each arranged in stripes at predetermined intervals with the gate lines 260 and cathode lines 270 perpendicular to one another, thereby forming an array of pixels. Here, the gate lines 260 and the cathode lines 270 are connected to the third electrode 230 and the first electrode 210 corresponding to each pixel, respectively, thereby transmitting an external signal to the third and first electrodes 230, 210.

Furthermore, the gate lines 260 and the third electrodes 230 can be separately formed of the same material or different materials and then connected to each other, or integrally formed of the same material. Likewise, the cathode lines 270 and the first electrodes 210 can be separately formed of the same material or different materials and then connected to each other, or integrally formed of the same material. In each pixel according to an embodiment shown in FIGS. 3 and 4, the third electrode 230 is formed integrally by the corresponding gate line 260 using the same material, but each first electrode 210 is formed separately from the corresponding cathode line 270 of different materials, which illustrates a nonlimiting example of the invention.

Meanwhile, each pixel comprises at least one opening 214 provided in an insulator 220 and allowing an electron emitter 240 formed on the first electrode 210 to be exposed to a fluorescent layer 252 formed on the second plate 250. Further, the third electrode 230 is electrically connected to the second electrode 212 formed on the same plane as the first electrode 210. Therefore, when a predetermined voltage is applied to the third electrode 230, the equivalent voltage is also applied to the second electrode 212. With this configuration, the voltage difference between the first electrode 210 and the third electrode 230 causes the electron emitter 140 to emit electrons and the emitted electron beam is focused by the third electrode 230 and the second electrode 212. For example, a positive voltage of 70V can be applied to the third electrode 230, and a negative voltage of −80V can be applied to the first electrode 210.

The second plate 250 comprises the fluorescent layer 252 arranged in a striped configuration and formed on at least one side of an anode electrode 256 at predetermined intervals. Here, the anode electrode 256 can be formed as a transparent electrode or a thin metal layer. Furthermore, the anode electrode 256 may be an integral-type electrode or of a striped configuration.

Referring to FIG. 4, the fluorescent layer 252 is opposite the electron emitter 240 formed on the first plate 200, and the area between the fluorescent layers forms a dark region 254. Further, the anode electrode 256 is provided lengthwise covering both the fluorescent layer 252 and the dark region 254. Here, the electrons emitted from the electron emitter 240 collide with the fluorescent layer 252, thereby causing the fluorescent layer 252 to emit visible light of red, green and blue. Meanwhile, the first and second plates 200 and 250 are supported by a well-known supporting means such as a spacer or the like, maintaining a space between them. In FIG. 4, one of the R (red), G (green) and B (blue) fluorescent layers 252 corresponds to one electron emitter 240. However, one of the R (red), G (green) and B (blue) fluorescent layers 252 may correspond to a plurality of electron emitters 240.

Suitable voltages to be applied are: to the third electrode 230, between about 10V and 120V, to the first electrode 210, between about −120V and −10V, and to anode electrode 256, between about 1 kV and a few kV, so as to accelerate the electron emitted from the electron emitter. Additionally, the focus of the electron beam can be adjusted by the third electrode, and thus the focus of the accelerated electron can be improved by optimizing the voltages applied to the third, first and anode electrodes.

Below, a process of fabricating the first plate for the electron emission display according to the embodiment of the present invention of FIGS. 2A, 3 and 4 will be described with reference to FIGS. 5A through 5D which are plan views illustrating a process for making an electron emission display according to one embodiment of the present invention.

Figure 5A:
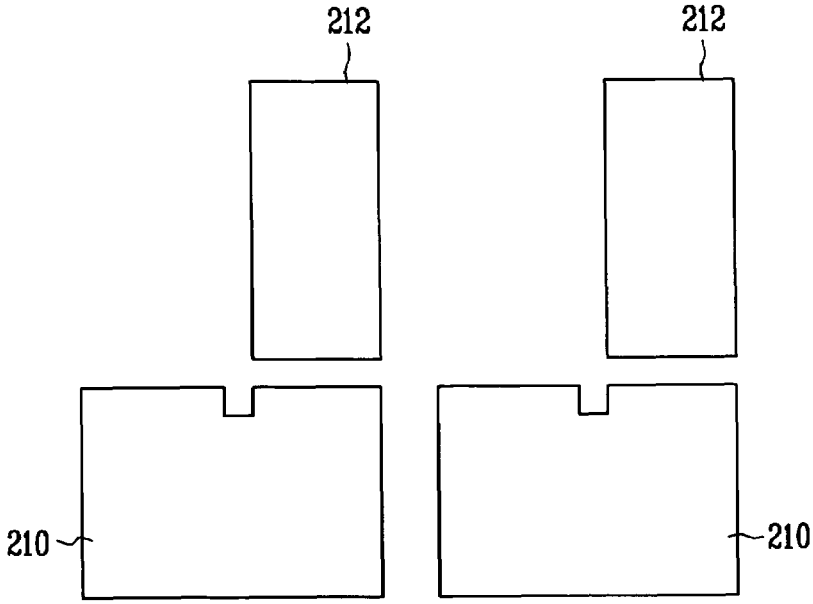
FIGS. 5A through 5D are plan views for illustrating a process for manufacturing an electron emission display according to a first embodiment of the present invention.

Referring to FIG. 5A, on the first plate 200 (see FIG. 4) are formed the first electrode 210 and the second electrode 212 spaced from each other at a predetermined distance. For example, a transparent conductive material such as indium tin oxide (ITO), zinc oxide (ZnO), etc. is formed on the first plate 200 to a thickness of 1,000 Å to 2,000 Å, and then the transparent conductive material is selectively etched, thereby forming the first electrode 210 and the second electrode 212. For example, the first electrode 210 and the second electrode 212 have a thickness of 1,300 Å.

Figure 5B:
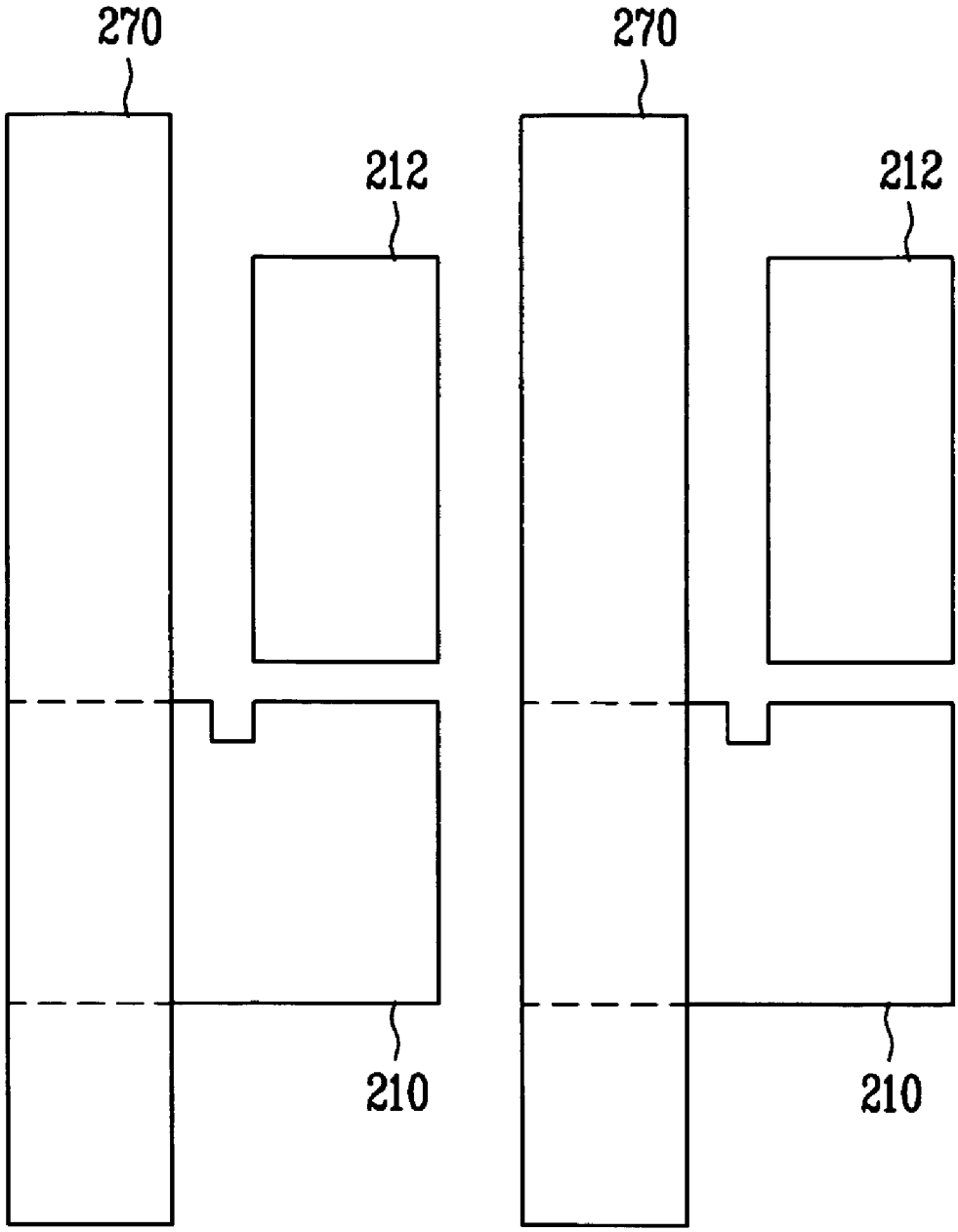

Referring to FIG. 5B, the cathode lines 270 are formed so as to transmit an external signal to the first electrode 210. For example, a metal such as chromium (Cr), or aluminum (Al) is deposited to a thickness of a few μm by any one of general deposition techniques such as by lithography or by screen-printing, and dried, thereby forming the cathode line 270. As described above, the cathode line 270 may be made of the same material as the first electrode 210.

Figure 5C:
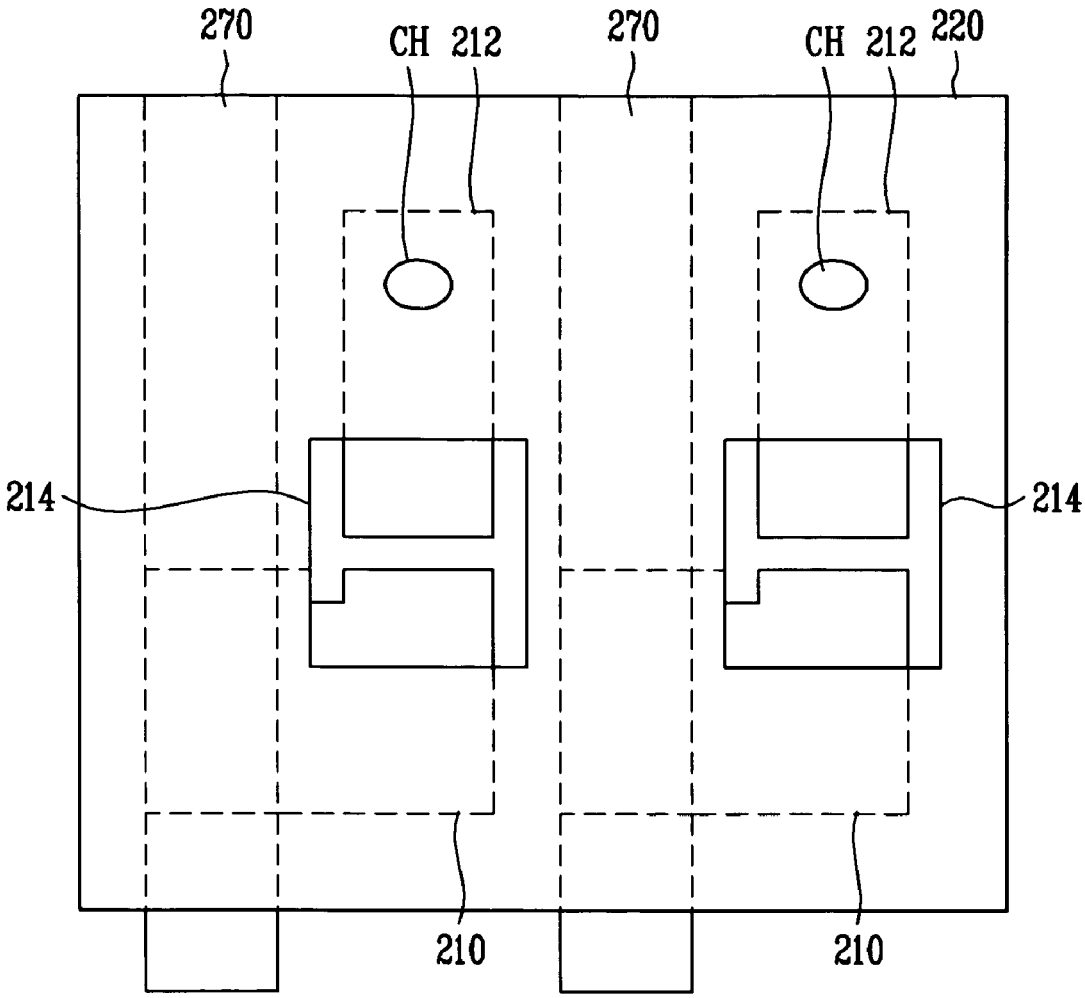

Referring to FIG. 5C, the insulator 220 is deposited to a thickness of about 20 μm by sputtering, chemical vapor deposition, vacuum deposition, lithography or screen-printing; and dried. Then, the contact holes (CH) and openings 214 are formed on the insulator 220, wherein the contact hole (CH) is used for connecting the third electrode 230 (refer to FIG. 5D) with the second electrode 212, and the opening 214 is used for exposing the electron emitter 240.

Figure 5D:
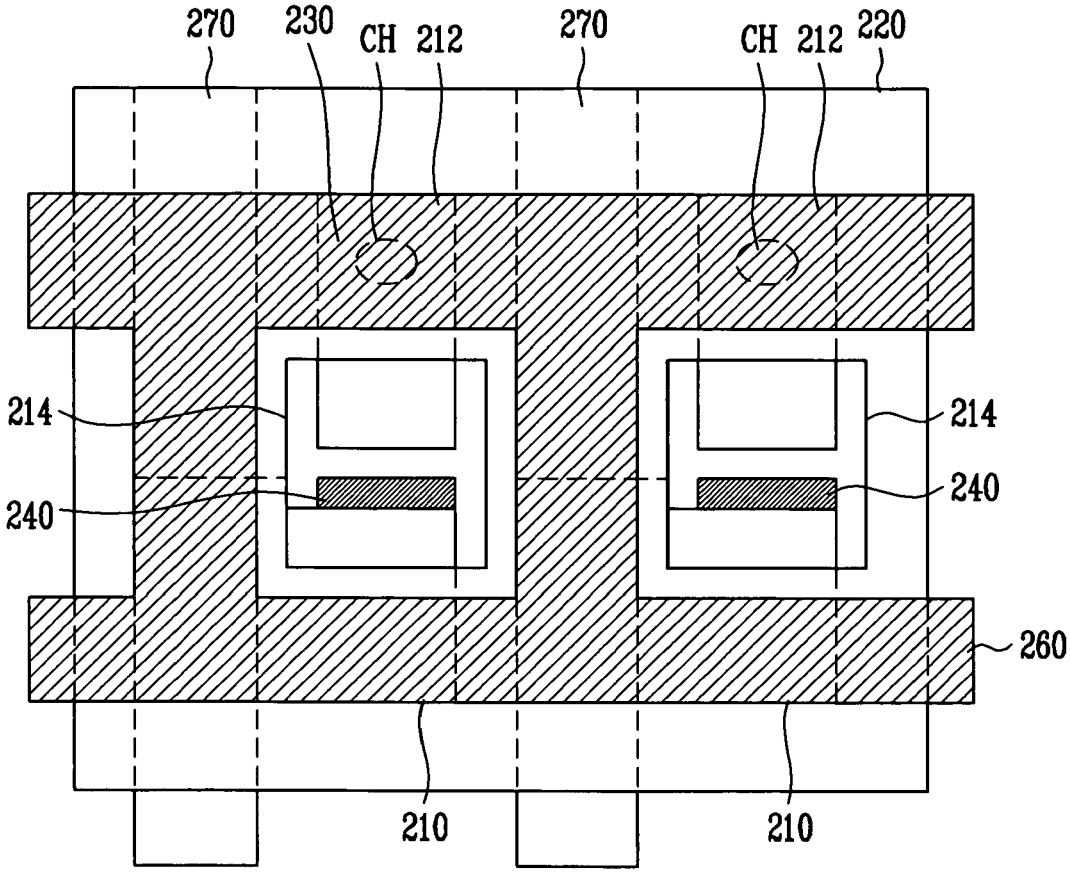

Referring to FIG. 5D, the electron emitter 240 comprising, for example, carbon nano tubes (CNT), is formed on a portion of the first electrode 210. The electron emitter 240 is exposed through the opening 214, through which electrons may be emitted. Furthermore, a metal such as chromium (Cr), aluminum (Al), etc. is deposited to a thickness of a few μm by any one of general deposition techniques such as by lithography or by screen-printing, and dried, thereby forming the gate lines 260 which also form the third electrodes 230.

Meanwhile, on the second plate 250 are formed the anode electrode 256 and the R, G and B fluorescent layers 252. Furthermore, it should be appreciated that the anode electrode 256 can be of the integral-type or of a stripe shape, and a well-known dark region may be added onto the second plate 250.

Second Embodiment

Electron Emission Device

Figure 6A:
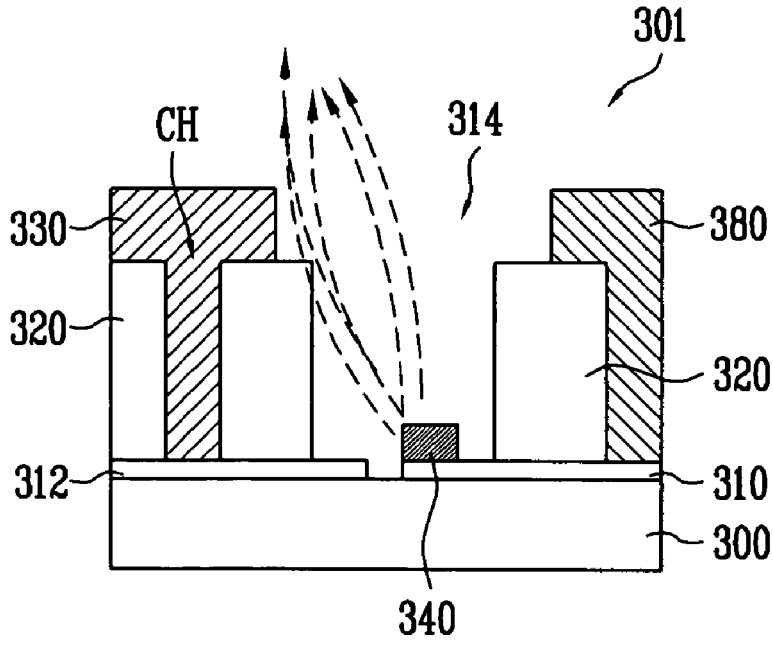
FIG. 6A through 6C are schematic views of electron emission devices according to still further embodiments of the present invention.
Figure 6B:
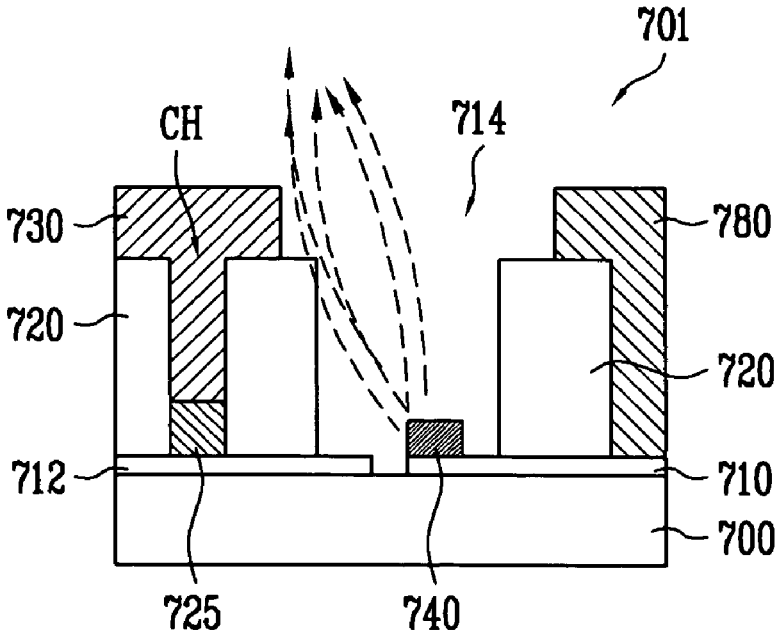
Figure 6C:
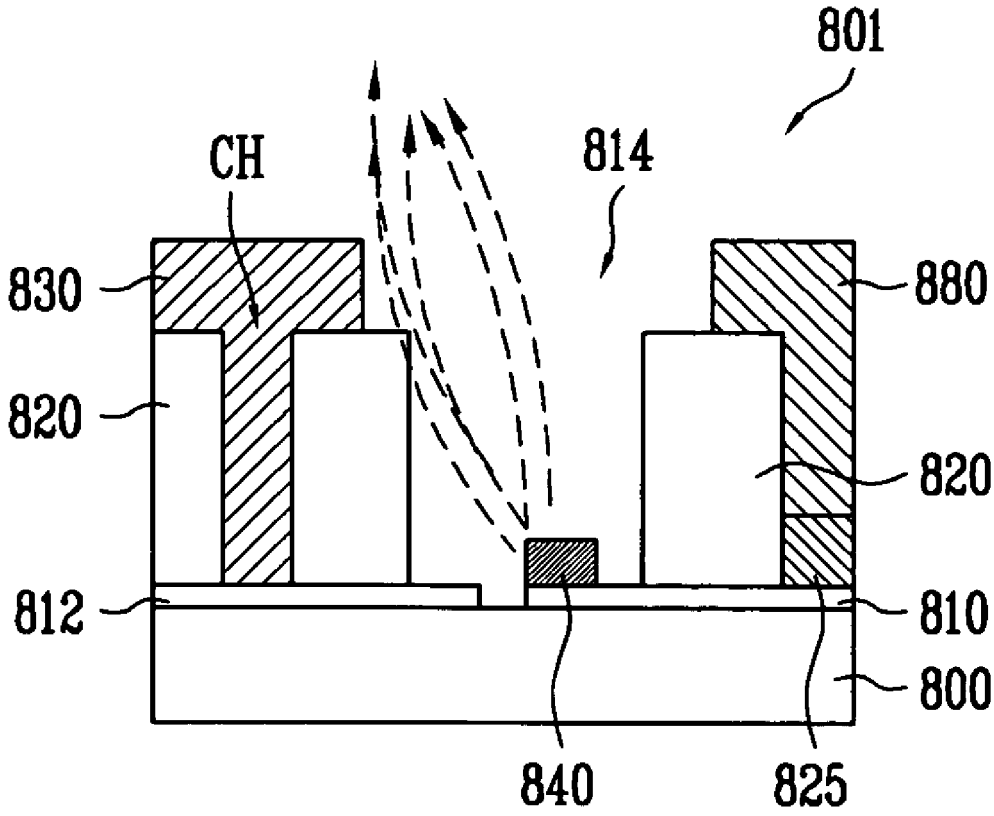

Below, an electron emission device according to another embodiment of the present invention will be described in detail with reference to accompanying drawings. FIG. 6A through 6C are schematic sectional views of electron emission devices according to different variations on this embodiment of the present invention. Here, the description will focus on the differences from the previous embodiments so as to avoid repetitive description.

Referring to FIG. 6A, an electron emission device 301 comprises first and second electrodes 310 and 312 formed on a plate 300 and spaced from each other by a predetermined distance; an insulator 320 formed on at least one of the first and second electrodes 310 and 312 and formed with an opening 314; an electron emitter 340; and third and fourth electrodes 330 and 380 formed on the insulator 320. FIG. 6A illustrates that the first and second electrodes 310 and 312 are partially exposed through the opening 314. The third electrode 330 and the fourth electrode 380 are formed on the insulator 320, leaving a space between them. The third electrode 330 is connected to the second electrode 312 through a first contact hole (CH1), and the fourth electrode 380 is connected to the first electrode 310 through a second contact hole (CH2). Therefore, when the voltage difference between the first electrode 310 and the second electrode 312 causes the electron emitter 340 to emit electrons, the emitted electron beam is focused by the third electrode 330 and the fourth electrode 380.

Because the third electrode 330 is electrically connected to the second electrode 312 through the first contact hole (CH1) formed inside the insulator 320, and the third electrode 330 is electrically connected to the second electrode 312 through the second contact hole (CH2), when the voltage difference between the first and second electrodes 310 and 312 causes the electron emitter 340 to emit electrons, an equivalent voltage is applied to the second electrode 312 and to the third electrode 330, and an equivalent voltage is applied to the first electrode 310 and the fourth electrode 380. Here, the fourth electrode 380 has a pushing effect on the emitted electrons, thereby improving focusing efficiency of the electron beam.

Figure 7:
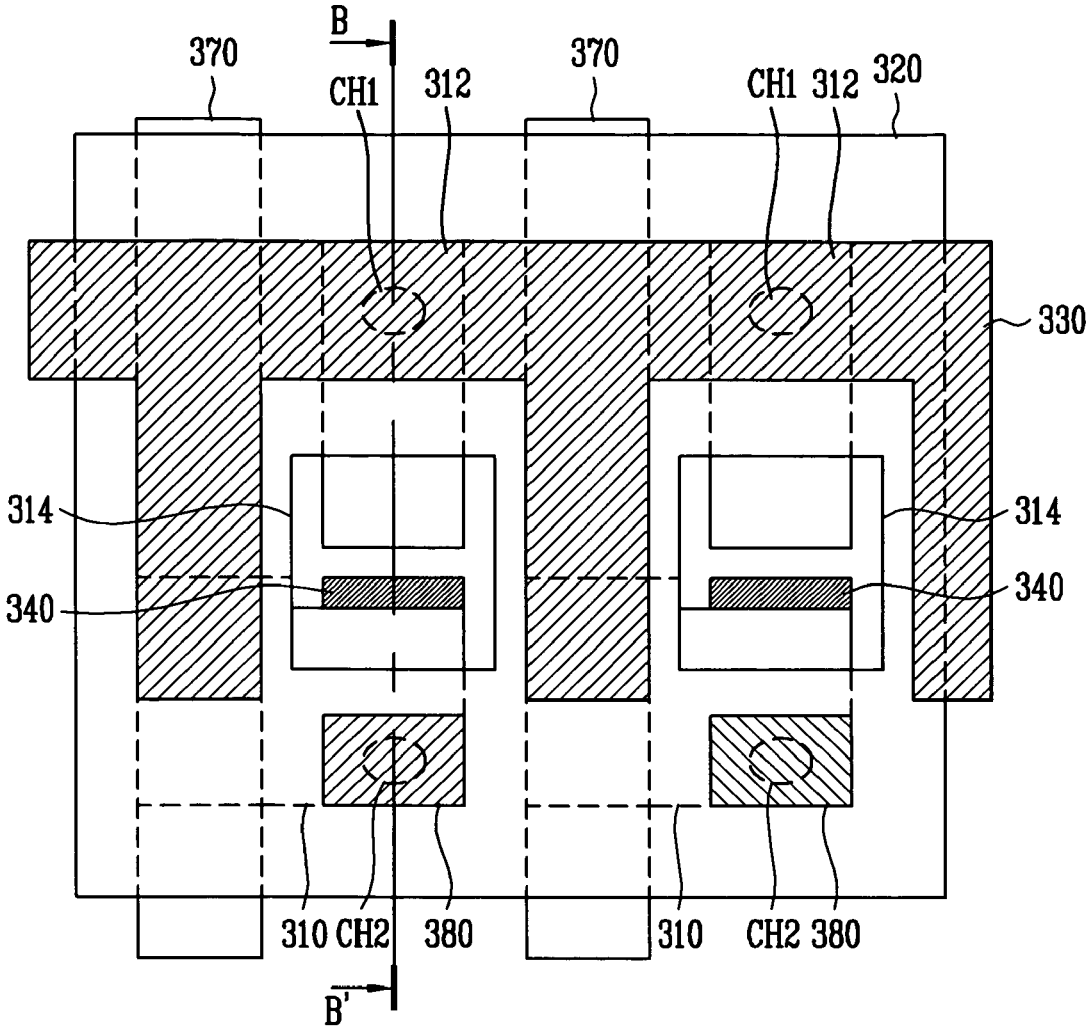
FIGS. 7 and 8 are schematic views of an electron emission display using the electron emission device of FIG. 6A.

The third electrode 330 and the fourth electrode 380 are spaced from each other on the plane of the insulator 320, but the invention is not limited to such a configuration, and may have various other configurations. Preferably, the third electrode 330 and the fourth electrode 380 are, as shown in FIG. 7, configured together surround the opening 314, thereby improving the focusing efficiency of the electron beam. For example, where the opening 314 is shaped like a rectangle, the third electrode 330 surrounds three sides of the rectangle and the fourth electrode 380 surrounds the other one side. Alternatively, for a rectangular opening 314, the third electrode 330 can surround two sides of the rectangle and the fourth electrode 380 can surround one or two other sides of the rectangle. The configuration of the third electrode 330 and the fourth electrode 380 can be optimized in consideration of the focusing efficiency according to the voltage applied thereto.

In one embodiment, the first electrode 310 is partially exposed through the opening 314 and formed with the electron emitter 340 thereon, while the second electrode 312 is wholly covered with the insulator. In this embodiment, current leakage is prevented. Alternatively, the entire area of the first electrode 310 except the electron emitter 340 thereof may be covered with the insulator 320.

FIG. 6B is a schematic sectional view of a variation of the electron emission device in FIG. 6A. Referring to FIG. 6B, an electron emission device 701 comprises first and second electrodes 710 and 712 formed on a plate 700 and spaced from each other by a predetermined distance; an insulator 720 formed on at least one of the first and second electrodes 710 and 712 with an opening 714; an electron emitter 740; and third and fourth electrodes 730 and 780 formed on the insulator 720.

The third electrode is electrically connected to the second electrode through a contact hole (CH), but in this embodiment, a resistive layer 725 is additionally provided between the second electrode 712 and the third electrode 730. The resistive layer 725 drops the voltage and is useful where the voltage applied to the third electrode 730 should be lower than that applied to the second electrode 712.

FIG. 6C is a schematic sectional view of still another variation of the electron emission device in FIG. 6A. Referring to FIG. 6C, an electron emission device 801 comprises first and second electrodes 810 and 812 formed on a plate 800 and spaced from each other by a predetermined distance; an insulator 820 formed on at least one of the first and second electrodes 810 and 812 with an opening 814; an electron emitter 840; and third and fourth electrodes 830 and 880 formed on the insulator 820. Compared to the electron emission device of FIG. 6B, the electron emission device of FIG. 6C comprises a resistive layer 825 provided between the first electrode 810 and the fourth electrode 880. In yet another embodiment, another resistive layer may be provided between the second electrode 812 and the third electrode 830.

Electron Emission Display

Figure 8:
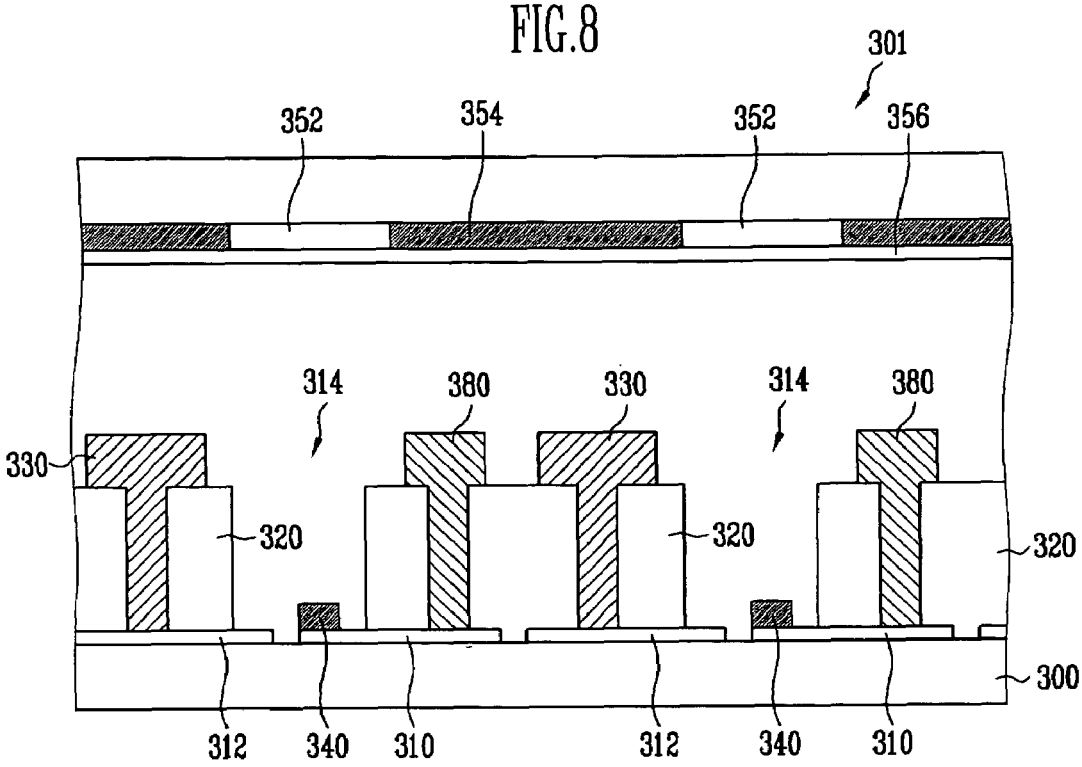

FIGS. 7 and 8 are views illustrating an electron emission display using the electron emission device of FIG. 6A, wherein FIG. 7 is a plan view of the electron emission display; and FIG. 8 is a sectional view of the electron emission display, taken along line B-B' in FIG. 7.

Here, the difference from the first embodiment will be described so that repetitive descriptions will be avoided. As shown there in FIGS. 7 and 8, an electron emission display 301 comprises a first plate 300 and a second plate 350 spaced from each other at a predetermined distance and facing each other. The two plates are sealed to one another to form a vacuum container.

Meanwhile, a pixel comprises at least one opening 314 provided in an insulator 320 with an electron emitter 340 formed on the first electrode 310 to be exposed to a fluorescent layer 352 formed on the second plate 350. The third electrode 330 is electrically connected to a second electrode 312 formed on the same plane as the first electrode 310, and the first electrode 310 is electrically connected to the fourth electrode 312.

FIGS. 9A through 9E are plan views illustrating a process for fabricating the electron emission display according to FIGS. 7 and 8. Here, the difference from the first embodiment will be described and repetitive descriptions will be avoided.

Figure 9A:
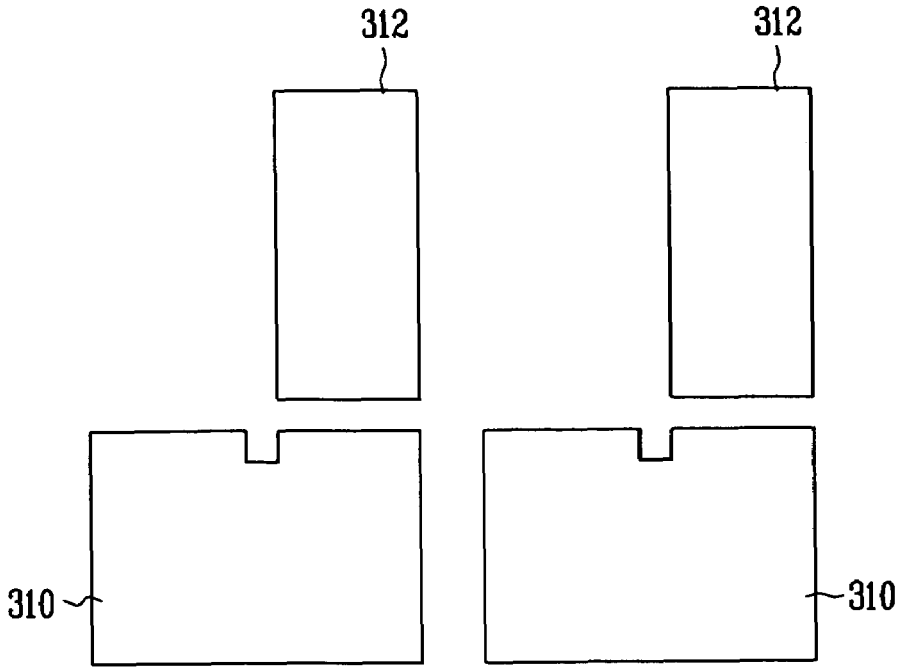
FIGS. 9A through 9E are plan views illustrating a process for manufacturing an electron emission display according to a second embodiment of the present invention.
Figure 9B:
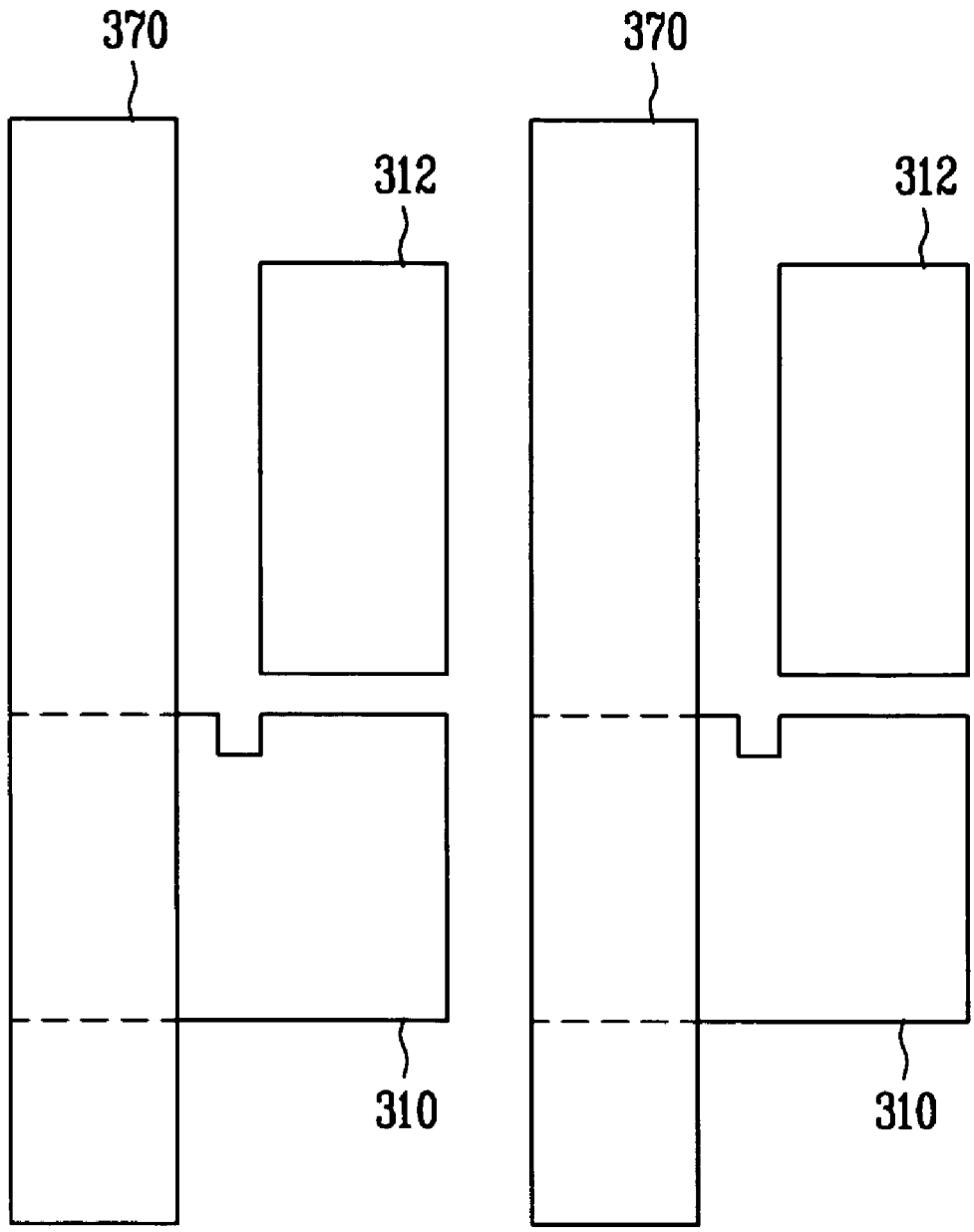
Figure 9C:
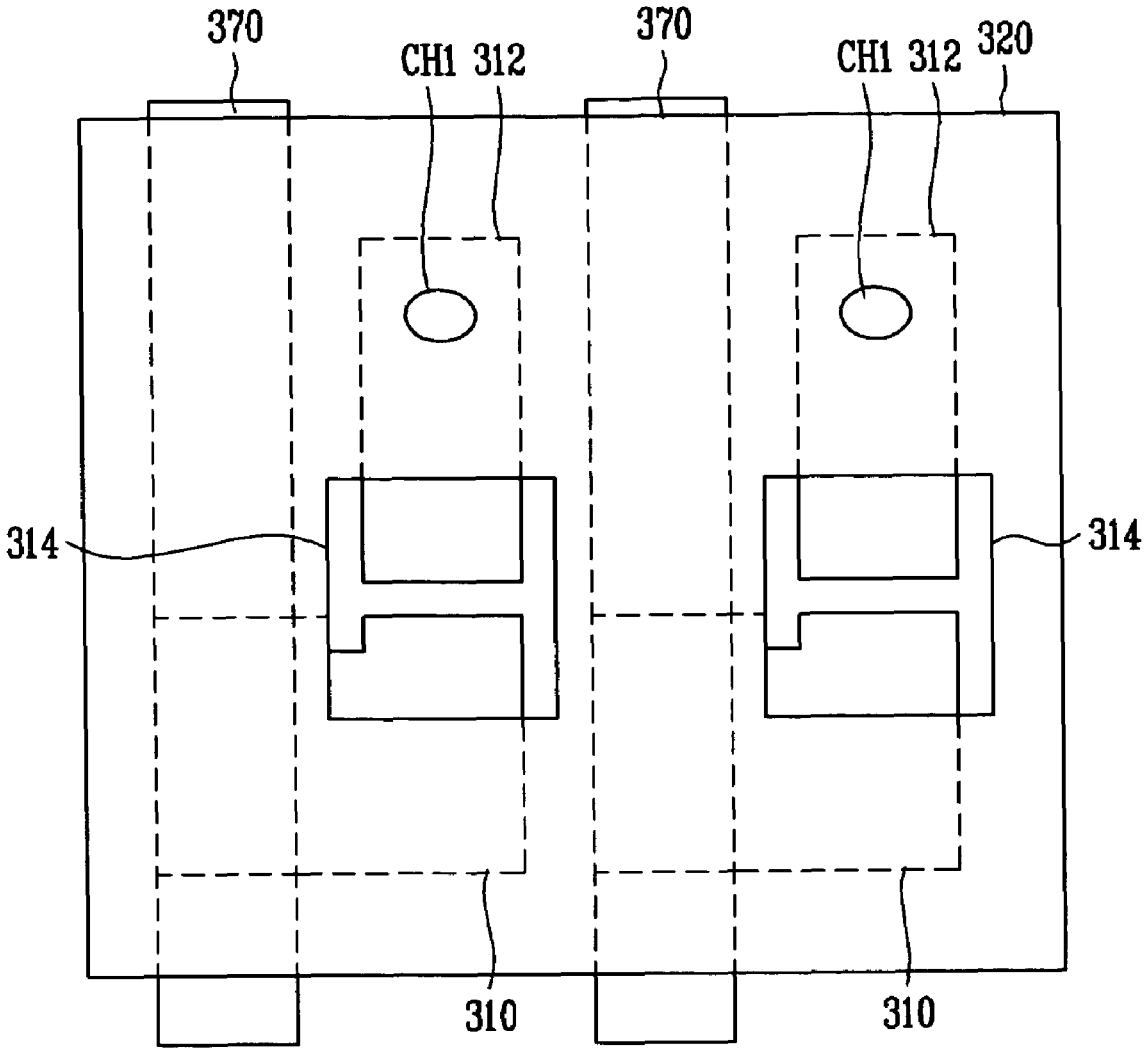

Referring to FIGS. 9A through 9C, on the first plate 300 are formed the first electrode 310 and the second electrode 312 spaced from each other by a predetermined distance. Then, a cathode line 370 is formed so as to transmit an external signal to the first electrode 310. Then, the insulator 320 is formed, and the first contact hole (CH1) and the opening 314 are formed on the insulator 320, wherein the first contact hole (CH1) is used for connecting the third electrode 330 with the second electrode 312, and the opening 314 is used for exposing the electron emitter 340.

Figure 9D:
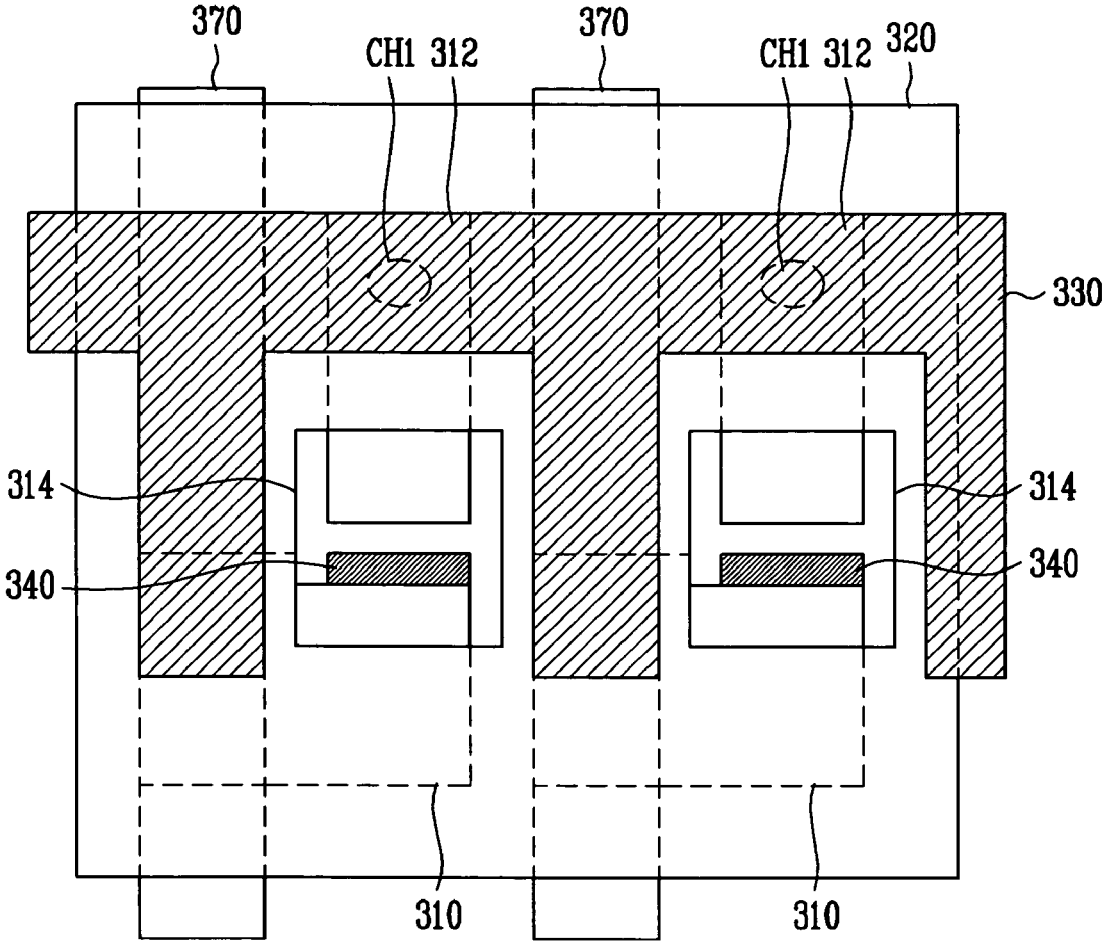

Referring to FIG. 9D, the electron emitter 340, e.g., a carbon nano tube (CNT), is formed on a portion of the first electrode 310. The electron emitter 340 is exposed through the opening 314 to permit emission of the electrons. Furthermore, the third electrode 330 is formed. Here, the difference between the first and second embodiments is that the insulator according to the first embodiment is formed with only the third electrode thereon, whereas the insulator 320 according to the second embodiment is formed with the fourth electrode 380 as well as the third electrode 330 thereon.

Figure 9E:
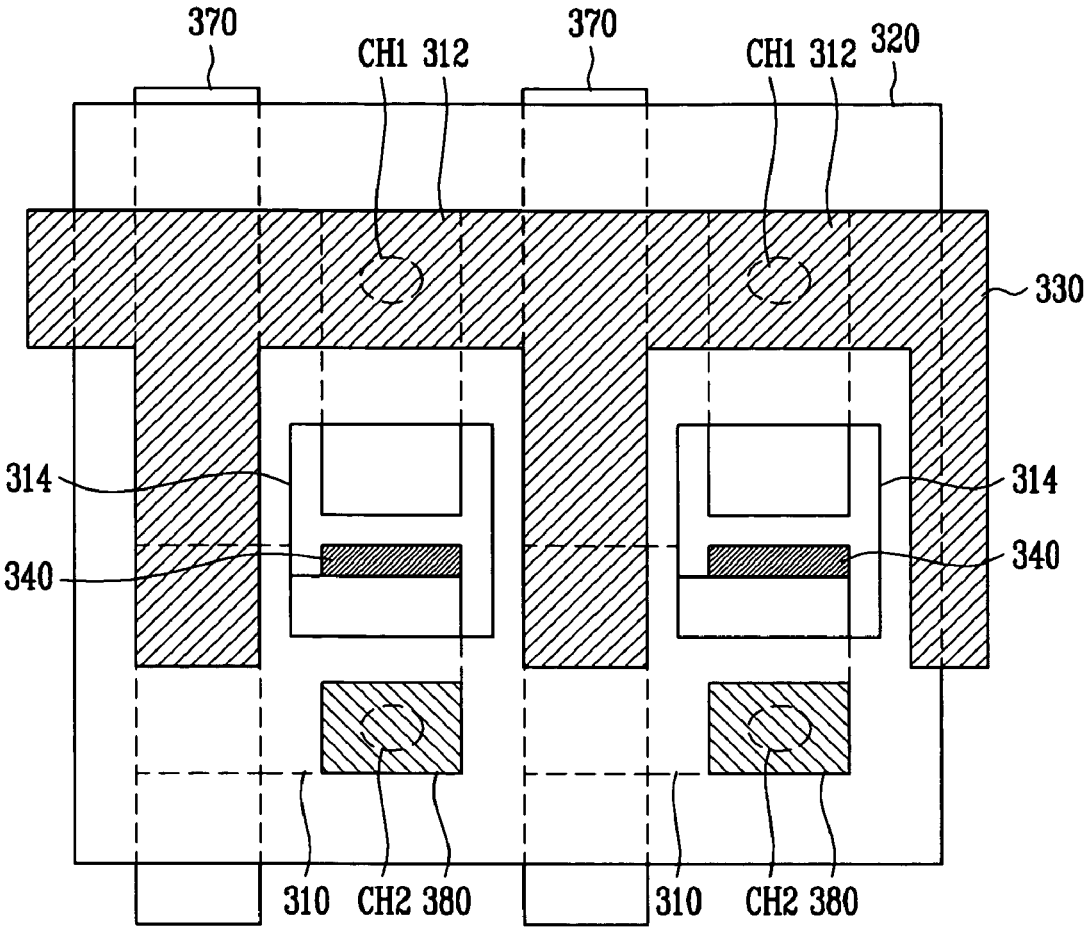

Referring to FIG. 9E, the insulator 320 is formed with the second contact hole (CH2) therein, entirely coated with a metal layer, and then patterned to form the fourth electrode 380.

According to the second embodiment, contrary to the first embodiment, both the third electrode 330 and the fourth electrode 380 are provided on the insulator 320, so that the focusing efficiency can be improved based on the configuration, shape, or size of the third electrode 330 and the fourth electrode 380. Here, the rectangular opening 314 is surrounded with the third electrode 330 and the fourth electrode 380. That is, referring to FIGS. 7 and 9E, the third electrode 330 has a "C" shape and surrounds three sides of the opening 314, and the fourth electrode 380 has a rectangular shape and partially surrounds the other one side of the opening 314. However, the third electrode 330 and the fourth electrode 380 may vary in configurations, shapes, or sizes.

FIGS. 10A through 10E are plan views for illustrating a process for making a variant electron emission display according to the second embodiment of the present invention. Here, the differences from the foregoing description will be described and repetitive descriptions will be avoided.

Figure 10A:
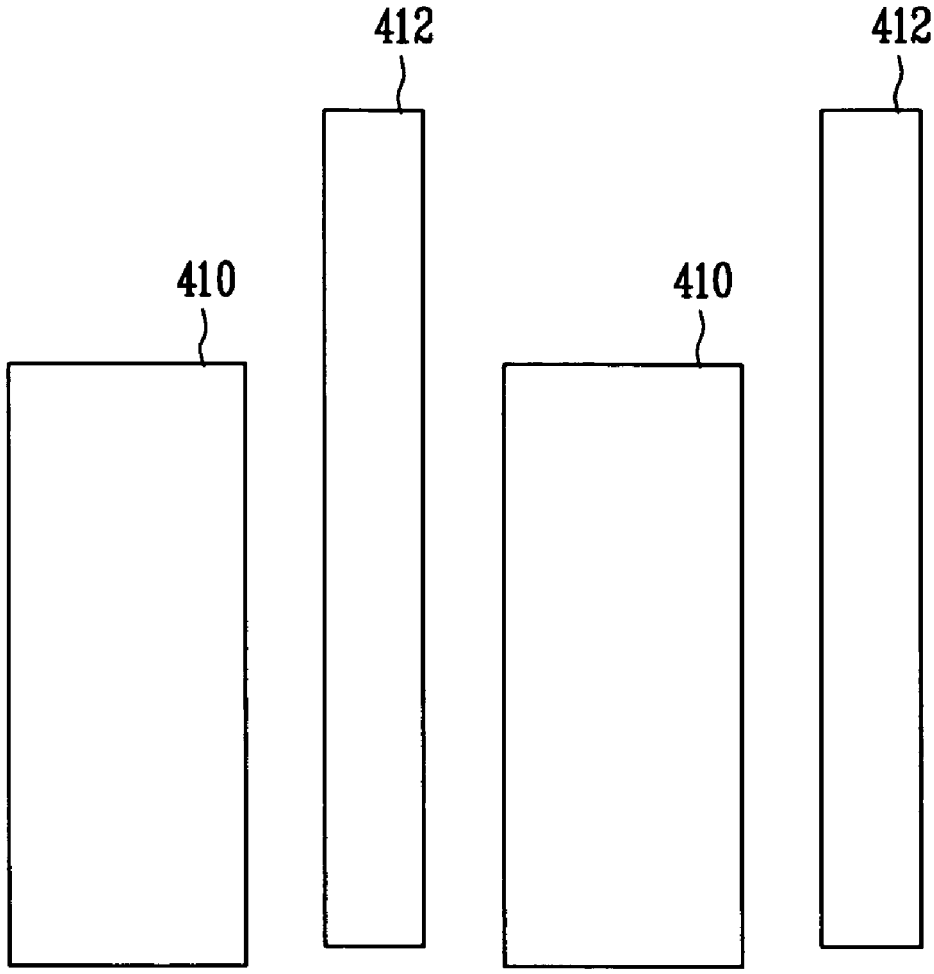
FIGS. 10A through 10E are plan views for illustrating a process for manufacturing another embodiment of an electron emission display.
Figure 10B:
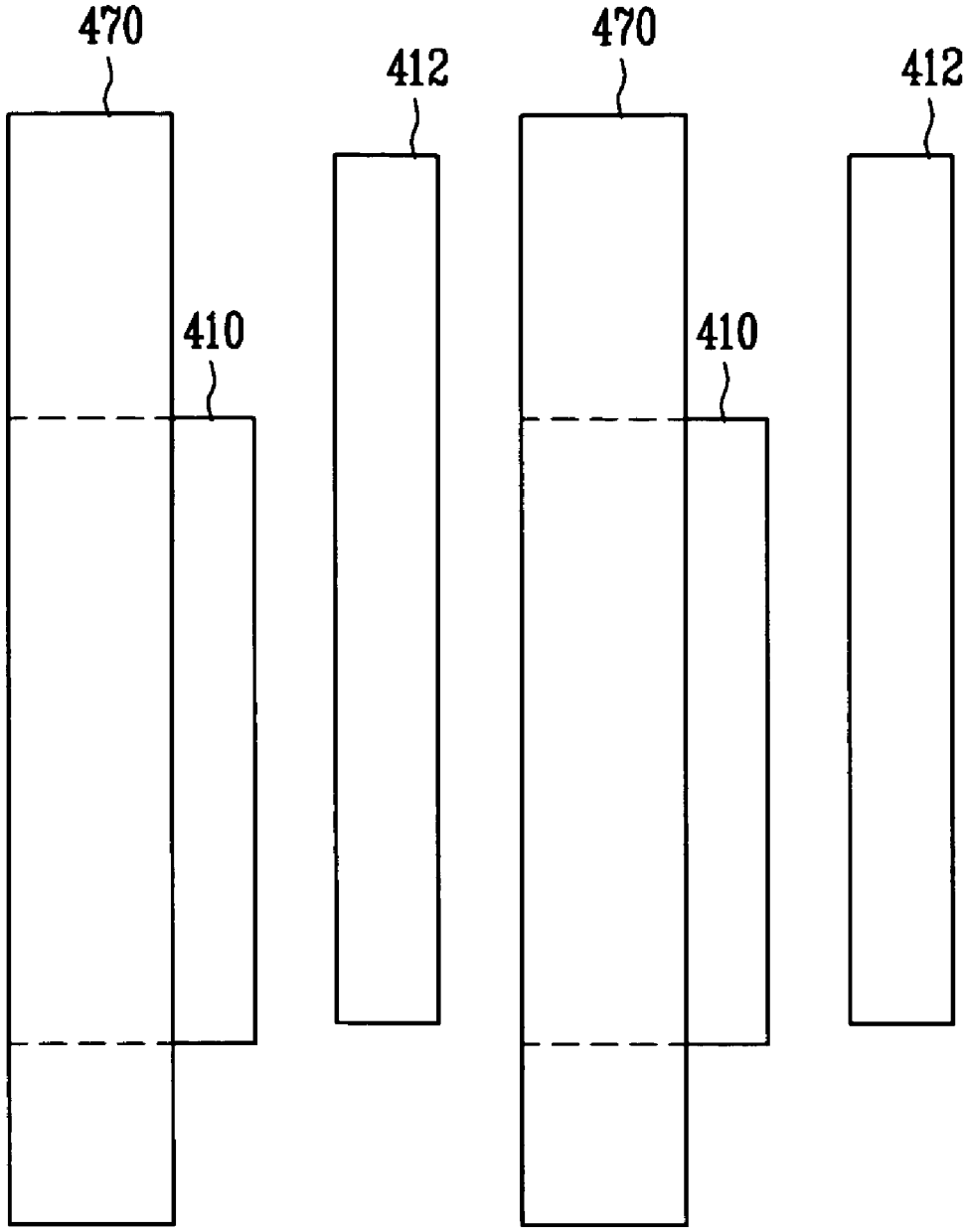
Figure 10C:
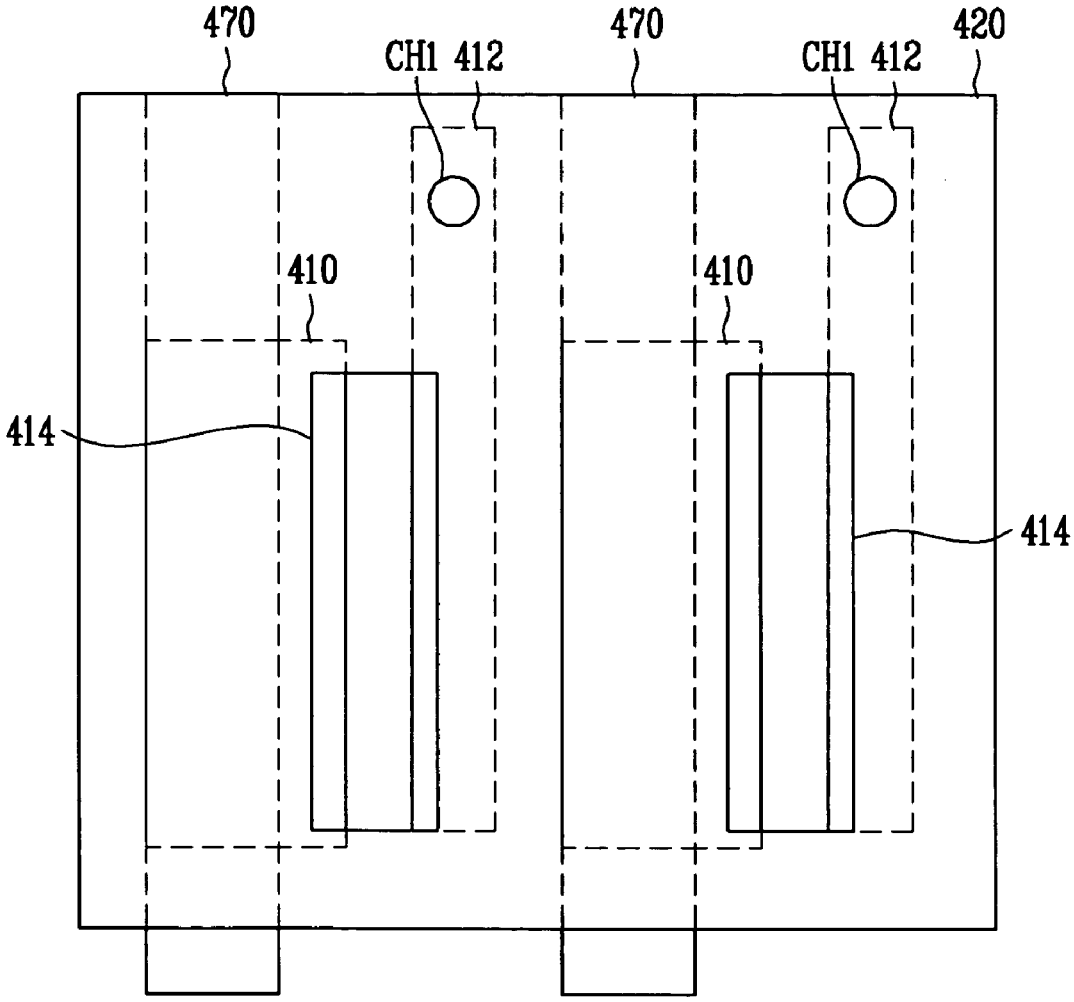

Referring to FIGS. 10A through 10C, like the foregoing description, on a plate 400 are formed a first electrode 410 and a second electrode 412 spaced from each other by a predetermined distance. Then, a cathode line 470 is formed for transmitting an external signal to the first electrode 410. As described above, the first electrode 410 and the second electrode 412 can be made of different materials or the same material if necessary. Then, an insulator 420 is formed, and a first contact hole (CH1) and an opening 414 are formed on the insulator 420, wherein the first contact hole (CH1) is used for connecting a third electrode 430 with the second electrode 412, and the opening 414 is used for exposing an electron emitter 440.

Figure 10D:
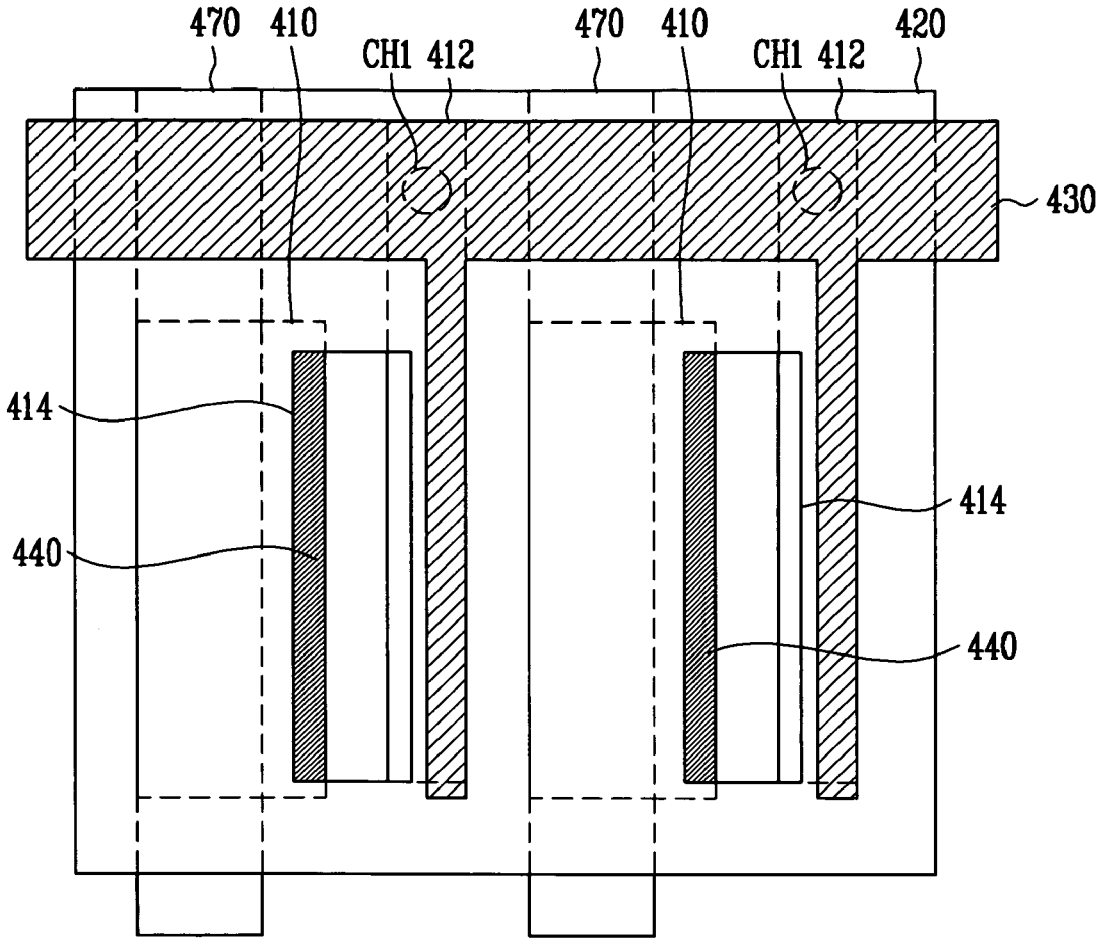
Figure 10E:
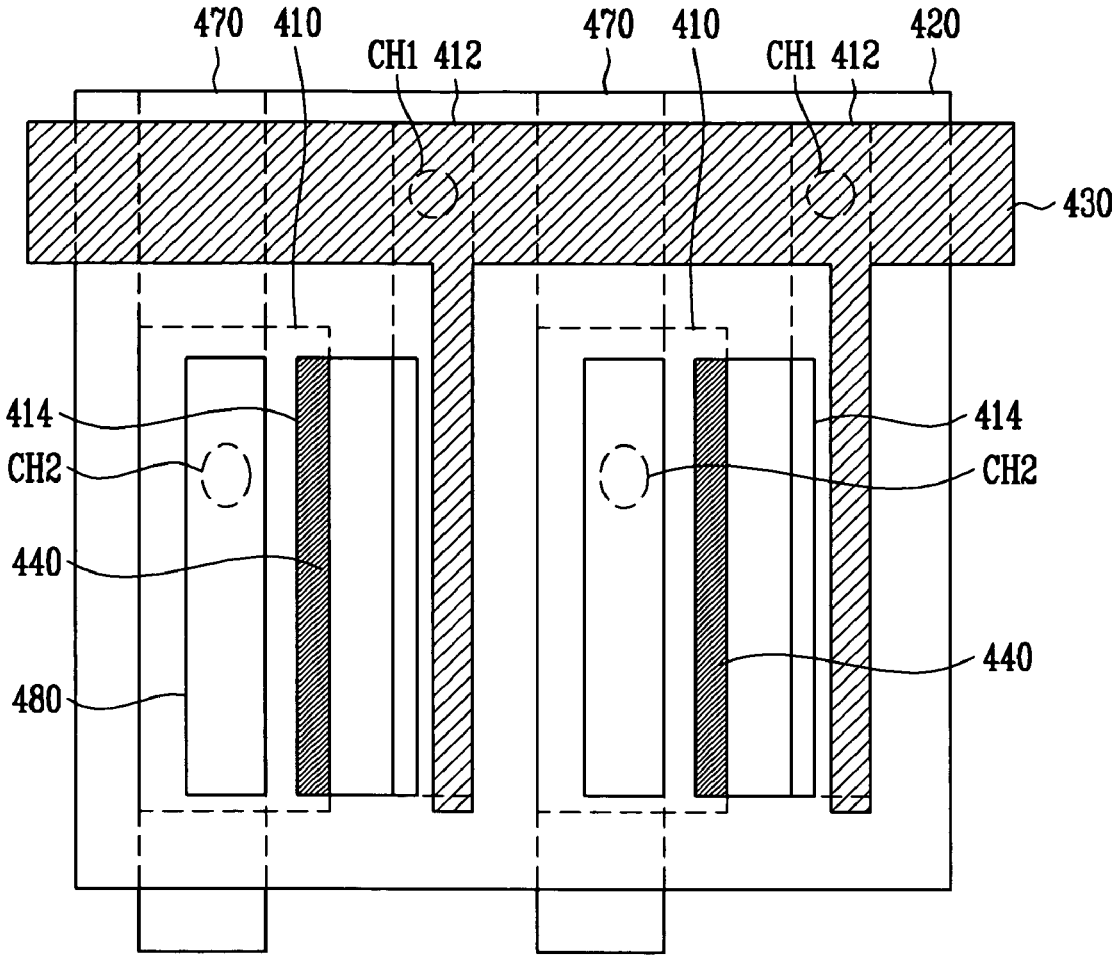

Referring to FIG. 10D, the electron emitter 440, e.g., a carbon nano tube (CNT), is formed on a portion of the first electrode 410. The electron emitter 440 is exposed through the opening 414 to permit the emission of electrons. Further, the third electrode 430 is formed. Here, the third electrode 430 has an "L" shape surrounding two sides of the rectangular opening 414 with respect to the pixel.

Referring to FIG. 9E, the insulator 420 is formed with a second contact hole (CH2) therein, and a fourth electrode 480 is formed thereon, wherein the fourth electrode 480 is in a strip shape corresponding to one other side of the opening 414.

According to this variance, the electron emitter 440 can be widened to increase the electron emission, thereby enhancing the brightness.

Alternatively, according to another variance, the opening 414 can be narrowed. That is, the second electrode 412 can be completely covered with the insulator 420. With this configuration, current leakage is prevented. Alternatively, the opening 414 may have a size corresponding to the size of the electron emitter 440, thereby exposing only the electron emitter 440.

Figure 11A:
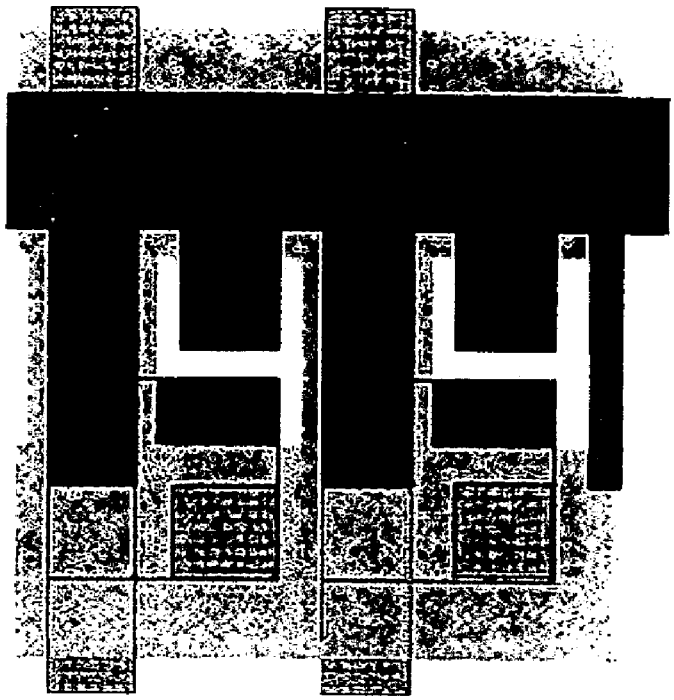
FIGS. 11A through 11B are views illustrating experimental simulation results for the electron emission device according to the second embodiment of the present invention.
Figure 11B:
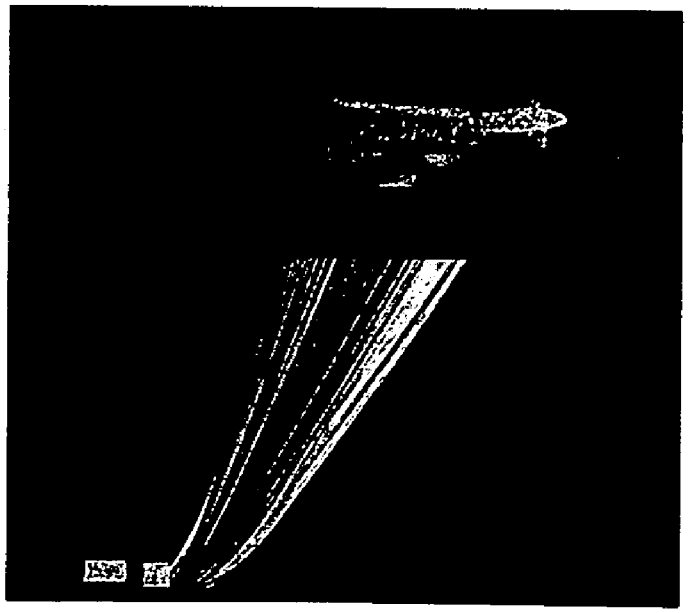

FIGS. 11A through 11B illustrate simulations representing the operation of an electron emission device according to the second embodiment of the present invention. FIG. 11A is a plan view of an electron emission device used in a simulation. This simulation is performed under conditions that the width of the CNT electron emitter is 83 μm, the cathode voltage is −80V, the gate voltage is 60V, and the anode voltage is 1 kV. FIG. 11B illustrates that the track of an electron beam is correspondingly focused on the pixel under the foregoing conditions.

Figure 12A:
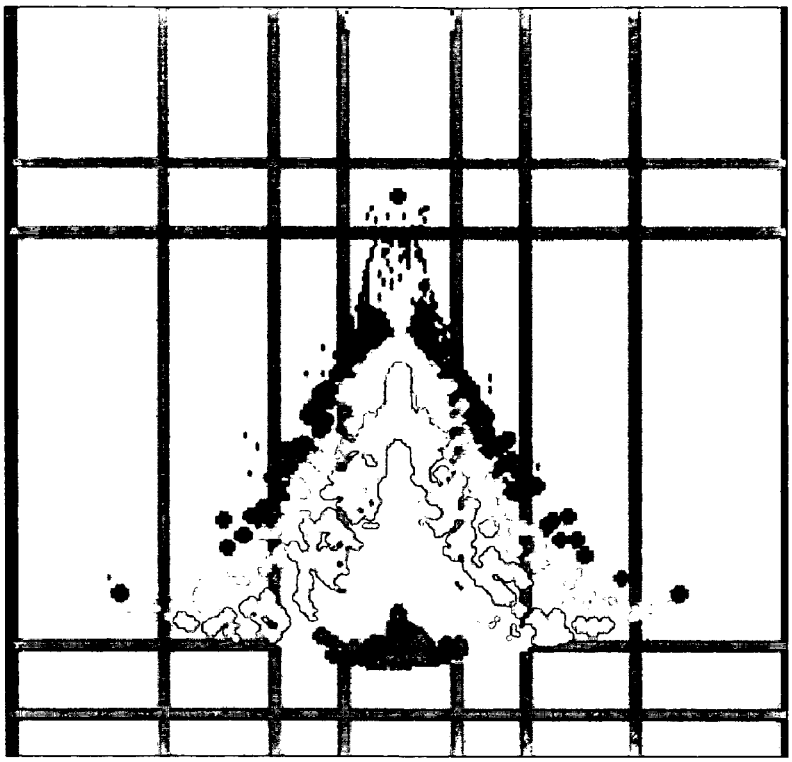
FIG. 12A is a photograph illustrating the beam focusing for a conventional electron emission device.
Figure 12B:
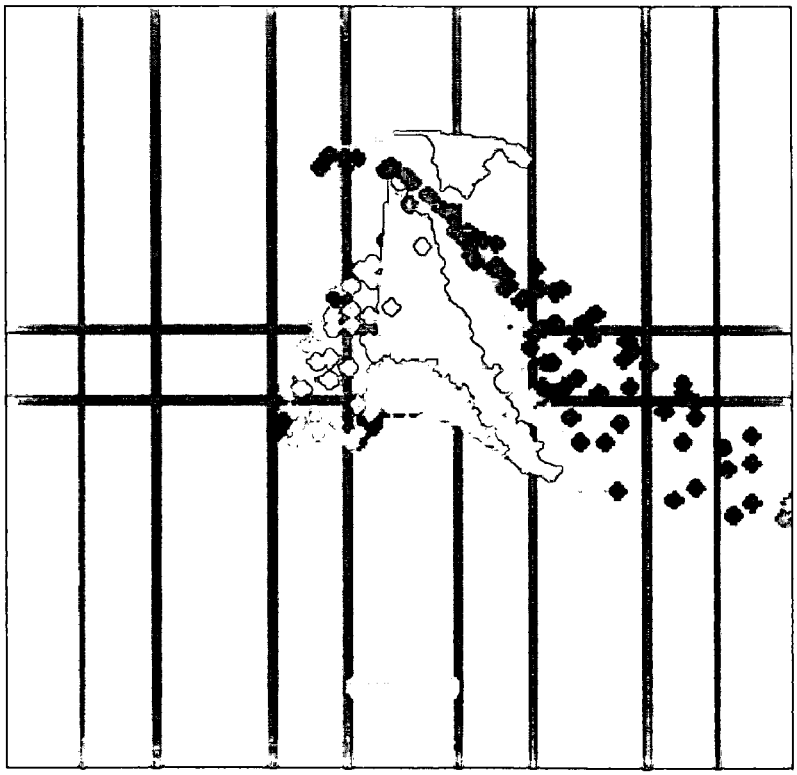
FIG. 12B is a photograph illustrating the beam focusing for the electron emission device of FIG. 11A.

A simulation was also performed to compare the beam focusing efficiency of the electron emission device according to the second embodiment of the present invention with that of a conventional electron emission device having an under gate structure. FIG. 12A is a photograph illustrating the beam focusing for a conventional electron emission device, and FIG. 12B is a photograph illustrating the beam focusing for the electron emission device of FIG. 11A. As shown therein, the beam focusing for the electron emission device of FIG. 11A is more effectively implemented than that for the conventional electron emission device. Here, FIG. 12B looks as if the right portion of the beam focusing is widely dispersed as compared with FIG. 12A, but that is because the configuration, shape, and size of the electron emission device was not yet optimized.

As described above, the present invention provides an electron emission device and an electron emission display using the same, wherein the electron emission device has an improved structure for focusing an electron beam, thereby simplifying the manufacturing process and lowering the production cost.

Where a conventional focusing means such as a mesh structure is added to the electron emission device of the present invention, the focusing efficiency of the electron beam is further enhanced. Additionally, for an anode electrode with the mesh structure, it is possible to increase anode voltage.

Although a few embodiments of the present invention have been shown and described, it would be appreciated by those skilled in the art that changes may be made in these embodiments without departing from the principles and spirit of the invention, the scope of which is defined by the claims and their equivalents.

What is claimed is:

1. An electron emission device comprising:

first and second electrodes on a plate and spaced from each other by a distance;

an insulator on the first and second electrodes and having an opening;

an electron emitter on a region of the first electrode and exposed through the opening; and a third electrode on the insulator and electrically connected to the second electrode, wherein a voltage difference between the first and second electrodes causes the electron emitter to emit electrons and the emitted electrons are focused by the third electrode, and wherein the first electrode is covered with the insulator except a portion occupied by the electron emitter, and wherein the second electrode is covered with the insulator except a portion electrically connected to the third electrode.

2. The electron emission device according to claim 1, wherein the third electrode surrounds the opening.

3. The electron emission device according to claim 1, wherein the electron emitter comprises a material selected from the group consisting of nano tubes, nano wire, fullerene ($C_{60}$), diamond-like carbon (DLC), graphite, or combinations thereof.

4. The electron emission device according to claim 1, wherein the first and second electrodes comprise the same material or different materials.

5. The electron emission device according to claim 1, wherein the third electrode is connected to the second electrode via a contact hole formed in the insulator.

6. The electron emission device according to claim 1, further comprising a resistance layer between the second electrode and the third electrode.

7. An electron emission display comprising:

a first plate;

a second plate opposite to and spaced from the first plate; and a supporter supporting the first and second plates to maintain a space between the first and second plates, wherein on the first plate are a gate line and a cathode line perpendicular to one another to define pixels, each pixel comprising at least one electron emission device, the electron emission device comprising:

first and second electrodes on the first plate and spaced from each other by a distance; an insulator on the first and second electrodes and having an opening; an electron emitter on a region of the first electrode and exposed through the opening; and a third electrode on the insulator and electrically connected to the second electrode, wherein a voltage difference between the first and second electrodes causes the electron emitter to emit electrons and the emitted electrons are focused by the third electrode, and wherein the first electrode is covered with the insulator except a portion occupied by the electron emitter, and wherein the second electrode is covered with the insulator except a portion electrically connected to the third electrode.

8. The electron emission display according to claim 7, wherein the gate line comprises the same material as the third electrode, and the cathode line is formed separately from the first electrode and connected to the first electrode.

* * * * *